US008453485B2

(12) United States Patent
Smith et al.

(10) Patent No.: US 8,453,485 B2
(45) Date of Patent: Jun. 4, 2013

(54) METHODS AND APPARATUS FOR CONTROLLING FLARE IN ROLL-FORMING PROCESSES

(75) Inventors: Gregory S. Smith, McPherson, KS (US); Jason E. Green, Keller, TX (US)

(73) Assignee: The Bradbury Company, Inc., Moundridge, KS (US)

( * ) Notice: Subject to any disclaimer, the term of this patent is extended or adjusted under 35 U.S.C. 154(b) by 55 days.

(21) Appl. No.: 12/551,255

(22) Filed: Aug. 31, 2009

(65) Prior Publication Data

US 2010/0139350 A1 Jun. 10, 2010

Related U.S. Application Data

(63) Continuation-in-part of application No. 11/424,444, filed on Jun. 15, 2006, now Pat. No. 7,591,161, which is a continuation of application No. 10/780,413, filed on Feb. 17, 2004, now Pat. No. 7,111,481.

(51) Int. Cl.
*B21D 5/08* (2006.01)
*B21D 7/022* (2006.01)

(52) U.S. Cl.
USPC ..... 72/176; 72/220

(58) Field of Classification Search
USPC ..... 72/107, 110, 115, 120, 121, 125, 72/181, 176–179, 210, 211, 214, 220
See application file for complete search history.

(56) References Cited

U.S. PATENT DOCUMENTS

| | | | | |
|---|---|---|---|---|
| 3,783,665 | A * | 1/1974 | Ashizawa | 72/81 |
| 4,117,702 | A | 10/1978 | Foster | |
| 4,558,577 | A | 12/1985 | Trishevsky et al. | |
| 4,559,577 | A | 12/1985 | Shoji et al. | |
| 4,787,232 | A | 11/1988 | Hayes | |
| 4,878,368 | A | 11/1989 | Toutant et al. | |
| 5,010,756 | A | 4/1991 | Nose et al. | |
| 5,722,278 | A | 3/1998 | Horino et al. | |
| 5,970,769 | A | 10/1999 | Lipari | |

(Continued)

FOREIGN PATENT DOCUMENTS

| | | |
|---|---|---|
| AU | 2005200334 | 8/2010 |
| AU | 2010214719 | 3/2011 |

(Continued)

OTHER PUBLICATIONS

European Patent Office, "Examination Report," issued in connection with related European application No. 07 020 337.7-2302, Apr. 7, 2009 (3 pages).

(Continued)

*Primary Examiner* — Teresa M Ekiert
(74) *Attorney, Agent, or Firm* — Hanley, Flight & Zimmerman, LLC

(57) ABSTRACT

Methods and apparatus for controlling flare in roll-forming processes are disclosed. An example method involves predefining a plurality of position values to adjust a tilt angle of a flange roller and adjusting the tilt angle of the flange roller based on one of the pre-defined position values to change an amount of flare in a zone of a component. The one of the pre-defined position values is associated with the zone of the component.

17 Claims, 18 Drawing Sheets

U.S. PATENT DOCUMENTS

| | | | | |
|---|---|---|---|---|
| 6,167,740 | B1 | 1/2001 | Lipari et al. | |
| 6,477,879 | B1 * | 11/2002 | Sawa | 72/220 |
| RE38,064 | E | 4/2003 | Morello | |
| 7,111,481 | B2 | 9/2006 | Green et al. | |
| 7,591,161 | B2 | 9/2009 | Green et al. | |
| 2005/0178181 | A1 | 8/2005 | Green et al. | |
| 2006/0272376 | A1 | 12/2006 | Green et al. | |

FOREIGN PATENT DOCUMENTS

| | | | |
|---|---|---|---|
| CA | 2 497 481 | | 8/2005 |
| CA | 2 714 126 | | 2/2011 |
| DE | 10 2007 005 614 | | 8/2008 |
| EP | 1 245 302 | | 10/2002 |
| EP | 1 563 922 | | 2/2005 |
| EP | 1 889 672 | | 2/2008 |
| EP | 1 889 672 | A1 | 2/2008 |
| EP | 2 289 642 | | 3/2011 |
| FR | 2 766 740 | | 2/1999 |
| WO | WO 9704892 | | 2/1997 |

OTHER PUBLICATIONS

European Patent Office, "European Search Report," issued in connection with related European application No. 07 020 337.7-2302, Jan. 18, 2008 (6 pages).

European Patent Office, "European Search Report," issued in connection with related European application No. 05 00 3058, Jun. 2, 2005 (3 pages).

European Patent Office, "Extended European Search Report," issued in connection with European application No. 10009001.8, Dec. 27, 2010 (7 pages).

IP Australia, "Examiner's First Report," issued in connection with Australian application No. 2005200334, Aug. 31, 2009, (1 page).

Canadian Intellectual Property Office, "Exam Report," issued in connection with Canadian application No. 2,497,481, May 4, 2011 (2 pages), TME.

European Patent Office, "Summons to Attend Oral Proceedings," issued in connection with European application No. 07020337.7, Jun. 10, 2011 (5 pages).

* cited by examiner

METHODS AND APPARATUS FOR CONTROLLING FLARE IN ROLL-FORMING PROCESSES

RELATED APPLICATIONS

This patent is a continuation-in-part of U.S. patent application Ser. No. 11/424,444, filed on Jun. 15, 2006, which is a continuation of U.S. patent application Ser. No. 10/780,413, filed on Feb. 17, 2004, both of which are hereby incorporated herein by reference in their entireties.

FIELD OF THE DISCLOSURE

The present disclosure relates generally to roll-forming processes and, more particularly, to methods and apparatus for controlling flare in roll-forming processes.

BACKGROUND

Roll-forming processes are typically used to manufacture formed components such as structural beams, siding, ductile structures, and/or any other component having a formed profile. A roll-forming process may be implemented using a roll-former machine or system having a sequenced plurality of forming passes. Each of the forming passes typically includes a roller assembly configured to contour, shape, bend, and/or fold a moving material. The number of forming passes required to form a component may be dictated by the material characteristics of the material (e.g., the material strength) and the profile complexity of the formed component (e.g., the number of bends, folds, etc. needed to produce a finished component). The moving material may be, for example, a metallic strip material that is unwound from coiled strip stock and moved through the roll-former system. As the material moves through the roll-former system, each of the forming passes performs a bending and/or folding operation on the material to progressively shape the material to achieve a desired profile. For example, the profile of a C-shaped component (well-known in the art as a CEE) has the appearance of the letter C when looking at one end of the C-shaped component.

A roll-forming process may be based on post-cut process or in a pre-cut process. A post-cut process involves unwinding a strip material from a coil and feeding the strip material through a roll-former system. In some cases, the strip material is first leveled, flattened, or otherwise conditioned prior to entering the roll-former system. A plurality of bending and/or folding operations is performed on the strip material as it moves through the forming passes to produce a formed material having a desired profile. The formed material is then removed from the last forming pass and moved through a cutting or shearing press that cuts the formed material into sections having a predetermined length. In a pre-cut process, the strip material is passed through a cutting or shearing press prior to entering the roll-former system. In this manner, pieces of formed material having a pre-determined length are individually processed by the roll-former system.

Formed materials or formed components are typically manufactured to comply with tolerance values associated with bend angles, lengths of material, distances from one bend to another, etc. In particular, bend angles that deviate from a desired angle are often associated with an amount of flare. In general, flare may be manifested in formed components as a structure that is bent inward or outward from a desired nominal position. For example, a roll-former system or portion thereof may be configured to perform one 90 degree bend on a material to produce an L-shaped profile. The roll-former system may be configured to form the L-shaped profile so that the walls of the formed component having an L-shaped profile form a 90 degree angle within, for example, a +/−5 degree flare tolerance value. If the first structure and the second structure do not form a 90 degree angle, the formed component is said to have flare. A formed component may be flared-in, flared-out, or both such as, for example, flared-in at a leading end and flared-out at a trailing end. Flare-in is typically a result of overforming and flare-out is typically a result of underforming. Additionally or alternatively, flare may be a result of material characteristics such as, for example, a spring or yield strength characteristic of a material. For example, a material may spring out (i.e., tend to return to its shape prior to a forming operation) after it exits a roll-forming pass and/or a roll-former system.

Flare is often an undesirable component characteristic and can be problematic in many applications. For example, formed materials are often used in structural applications such as building construction. In some cases, strength and structural support calculations are performed based on the expected strength of a formed material. In these cases, tolerance values such as flare tolerance values are very important because they are associated with an expected strength of the formed materials. In other cases, controlling flare tolerance values is important when interconnecting (e.g., welding) one formed component to another formed component. Interconnecting formed components typically requires that the ends of the formed components are substantially similar or identical.

Traditional methods for controlling flare typically require a significant amount of setup time to control flare uniformly throughout a formed component. Some roll-former systems are not capable of controlling flare uniformly throughout a formed component. In general, one known method for controlling flare involves changing positions of roller assemblies of forming passes, moving a material through the forming passes, measuring the flare of the formed components, and re-adjusting the positions of the roller assemblies based on the measured flare. This process is repeated until the roller assemblies are set in a position that reduces the flare to be within a specified flare tolerance. The roller assemblies then remain in a fixed position (i.e., static setting) throughout the operation of the roll-former system. Another known method for controlling flare involves adding a straightener fixture or flare fixture in line with the forming passes of a roll-former system. The straightener fixture or flare fixture includes one or more idle rollers that are set to a fixed position and apply pressure to flared surfaces of a formed component to reduce flare. Unfortunately, static or fixed flare control methods, such as those described above, allow flare to vary along the length of the formed components.

DETAILED DESCRIPTION

Figure 1A:
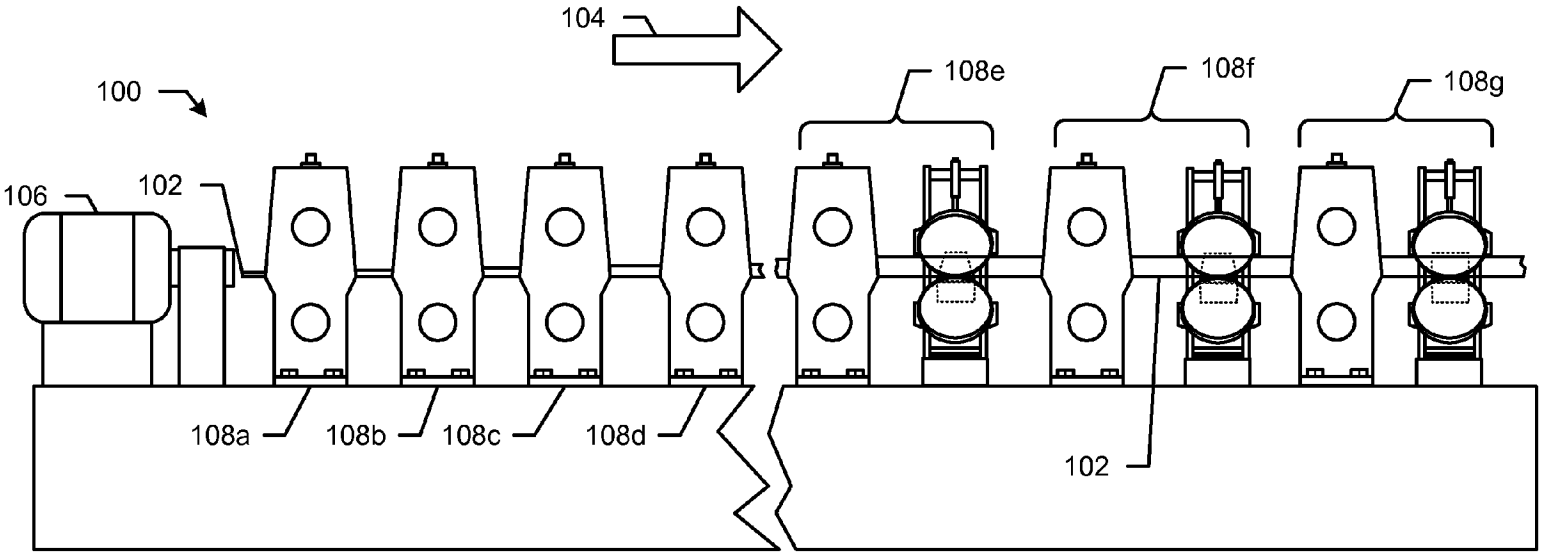
FIG. 1A is an elevational view and FIG. 1B is a plan view of an example roll-former system that may be used to form components from a moving material.
Figure 1B:
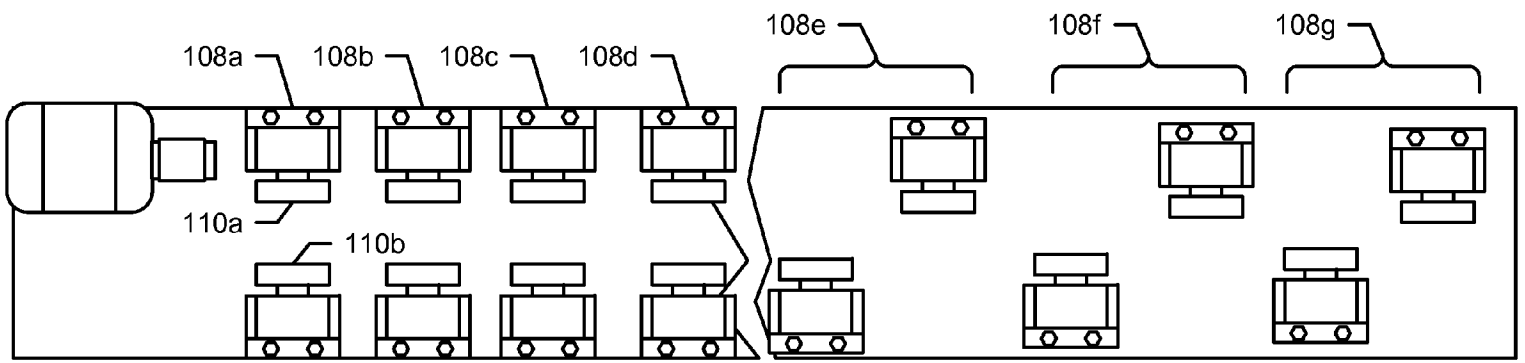

FIG. 1A is an elevational view and FIG. 1B is a plan view of an example roll-former system that may be used to form components from a strip material 102. The example roll-former system 100 may be part of, for example, a continuously moving material manufacturing system. Such a continuously moving material manufacturing system may include a plurality of subsystems that modify or alter the material 102 using processes that, for example, unwind, fold, punch, and/or stack the material 102. The material 102 may be a metallic strip or sheet material supplied on a roll or may be any other metallic or non-metallic material. Additionally, the continuous material manufacturing system may include the example roll-former system 100 which, as described in detail below, may be configured to form a component such as, for example, a metal beam or girder having any desired profile. For purposes of clarity, a C-shaped component 200 (FIG. 2A) having a C-shaped profile (i.e., a CEE profile) and a Z-shaped component 250 (FIG. 2B) having a Z-shaped profile (i.e., a ZEE profile) are described below in connection with FIGS. 2A and 2B. The example components 200 and 250 are typically referred to in the industry as purlins, which may be formed by performing a plurality of folding or bending operations on the material 102.

The example roll-former system 100 may be configured to form, for example, the example components 200 and 250 from a continuous material in a post-cut roll-forming operation or from a plurality of sheets of material in a pre-cut roll-forming operation. If the material 102 is a continuous material, the example roll-former 100 may be configured to receive the material 102 from an unwind stand (not shown) and drive, move, and/or translate the material 102 in a direction generally indicated by the arrow 104. Alternatively, the example roll-former 100 may be configured to receive the material 102 from a shear (not shown) if the material 102 is a pre-cut sheet of material (e.g., a fixed length of a strip material).

The example roll-former system 100 includes a drive unit 106 and a plurality of forming passes 108*a-g*. The drive unit 106 may be operatively coupled to and configured to drive portions of the forming passes 108*a-g* via, for example, gears, pulleys, chains, belts, etc. Any suitable drive unit such as, for example, an electric motor, a pneumatic motor, etc. may be used to implement the drive unit 106. In some instances, the drive unit 106 may be a dedicated unit that is used only by the example roll-former system 100. In other instances, the drive unit 106 may be omitted from the example roll-former system 100 and the forming passes 108*a-g* may be operatively coupled to a drive unit of another system in a material manufacturing system. For example, if the example roll-former 100 is operatively coupled to a material unwind system having a material unwind system drive unit, the material unwind system drive unit may be operatively coupled to the forming passes 108*a-g*.

The forming passes 108*a-g* work cooperatively to fold and/or bend the material 102 to form the formed example components 200 and 250. Each of the roll-forming passes 108*a-g* may include a plurality of forming rolls described in connection with FIGS. 4 through 6 that may be configured to apply bending forces to the material 102 at predetermined folding lines as the material 102 is driven, moved, and/or translated through the example roll-former system 100 in the direction 104. More specifically, as the material 102 moves through the example roll-former system 100, each of the forming passes 108*a-g* performs an incremental bending or forming operation on the material 102 as described in detail below in connection with FIG. 3.

In general, if the example roll-former system 100 is configured to form a ninety-degree fold along an edge of the material 102, more than one of the forming passes 108*a-g* may be configured to cooperatively form the ninety-degree angle bend. For example, the ninety-degree angle may be formed by the four forming passes 108*a-d*, each of which may be configured to perform a fifteen-degree angle bend in the material 102. In this manner, after the material 102 moves through the forming pass 108*d*, the ninety-degree angle bend is fully formed. The number of forming passes in the example roll-former system 100 may vary based on, for example, the strength, thickness, and type of the material 102. In addition, the number of forming passes in the example roll-former system 100 may vary based on the profile of the formed component such as, for example, the C-shape profile of the example C-shaped component 200 and the Z-shape profile of the example Z-shaped component 250.

As shown in FIG. 1B, each of the forming passes 108*a-d* includes a pair of forming units such as, for example, the forming units 110*a* and 110*b* that correspond to opposite sides of the material 104. Additionally, as shown in FIG. 1B, the forming passes 108*e-g* include staggered forming units. The forming units 110*a* and 110*b* may be configured to perform bends on both sides or longitudinal edges of the material 102 in a simultaneous manner. As the material 102 is incrementally shaped or formed by the forming passes 108*a-g*, the overall or effective width of the material 102 is reduced. As the overall width of the material 102 is reduced, forming unit pairs (e.g., the forming units 110*a* and 110*b*) or forming rolls of the forming unit pairs may be configured to be closer together to further bend the material 102. For some forming processes, the width of the material 102 may be reduced to a width that would cause the rolls of opposing forming unit pairs to interfere (e.g., contact) each other. For this reason, each of the forming passes 108*e-g* is configured to include staggered forming units.

Figure 2A:
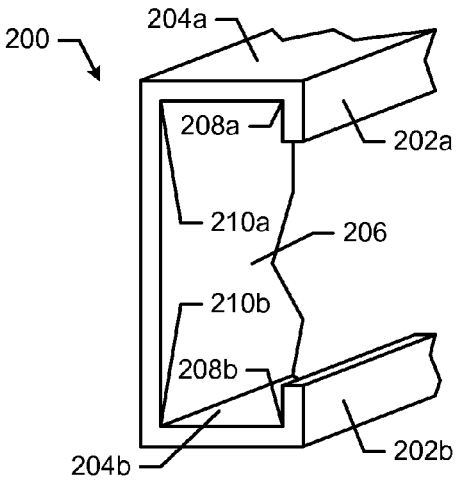
FIGS. 2A and 2B are isometric views of a C-shaped component and a Z-shaped component, respectively.
Figure 2B:
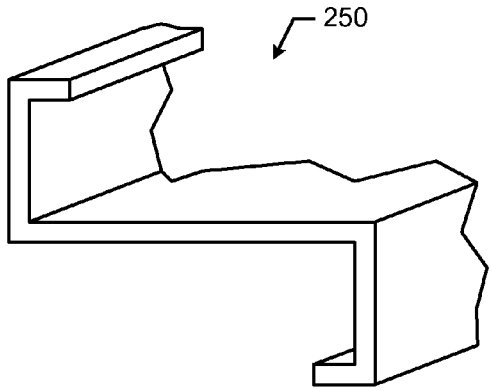

FIGS. 2A and 2B are isometric views of the example C-shaped component 200 and the example Z-shaped component 250, respectively. The example C-shaped component 200 and the example Z-shaped component 250 may be formed by the example roll-former system 100 of FIGS. 1A and 1B. However, the example roll-former system 100 is not limited to forming the example components 200 and 250. As shown in FIG. 2A, the C-shaped component 200 includes two return structures 202*a* and 202*b*, two flange structures 204*a* and 204*b*, and a web structure 206 disposed between the flange structures 204*a* and 204*b*. As described below in connection with FIG. 3, the return structures 202*a-b*, the flange structures 204*a-b*, and the web structure 206 may be formed by folding the material 102 at a plurality of folding lines 208*a*, 208*b*, 210*a*, and 210*b*.

Figure 3:
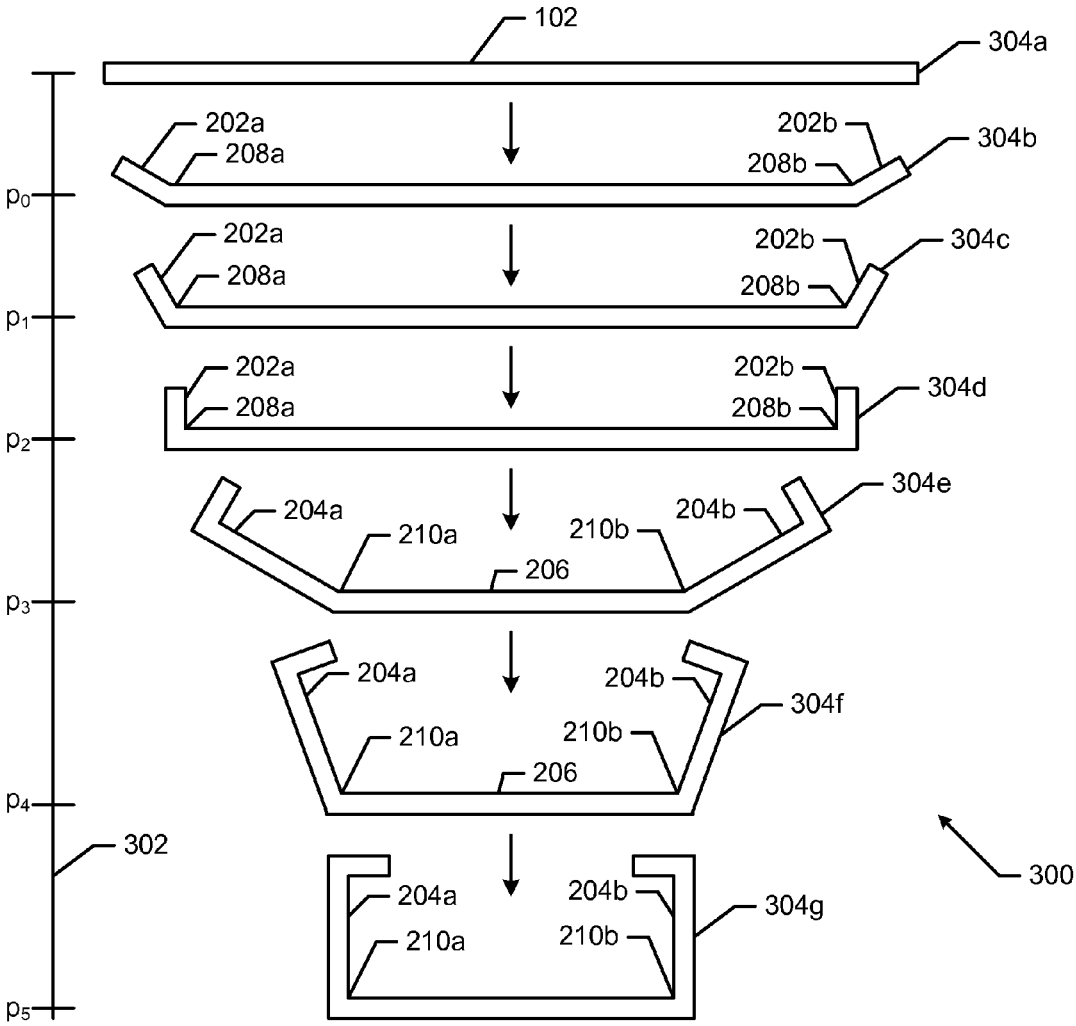
FIG. 3 is an example of a sequence of forming passes that may be used to make the C-shaped component of FIG. 2A.

FIG. 3 is an example of a sequence of forming passes 300 that may be used to make the example C-shaped component 200 of FIG. 2A. The example forming pass sequence 300 is illustrated using the material 102 (FIG. 1A) and a forming pass sequence line 302 that shows a plurality of forming passes $p_0$-$p_5$ associated with folds or bends that create a corresponding one of a plurality of component profiles 304*a-g*. The forming passes $p_0$-$p_5$ may be implemented by, for example, any combination of the forming passes 108*a-g* of FIGS. 1A and 1B. As described below, the folds or bends associated with the passes $p_0$-$p_5$ are applied along the plurality of folding lines 208*a-b* and 210*a-b* (FIG. 2A) to create the return structures 202*a-b*, the flange structures 204*a-b*, and the web structure 206 shown in FIG. 2A.

As depicted in FIG. 3, the material 102 has an initial component profile 304*a*, which corresponds to an initial state on the forming pass sequence line 302. The return structures 202*a-b* are formed in passes $p_0$ through $p_2$. The pass $p_0$ is associated with a component profile 304*b*. The pass $p_0$ may be implemented by, for example, the forming pass 108*a*, which may be configured to perform a folding operation along folding lines 208*a-b* to start the formation of the return structures 202*a* and 202*b*. The material 102 is then moved through the pass $p_1$, which may be implemented by, for example, the forming pass 108*b*. The pass $p_1$ performs a further folding or bending operation along the folding lines 208*a* and 208*b* to form a component profile 304*c*, after which the pass $p_2$ receives the material 102. The pass $p_2$, which may be implemented by the forming pass 108*c*, may be configured to perform a final folding or bending operation at the folding lines 208*a* and 208*b* to complete the formation of the return structures 202*a* and 202*b* as shown in a component profile 304*d*.

The flange structures 204*a* and 204*b* are then formed in passes $p_3$ through $p_5$. The pass $p_3$ may be implemented by the forming pass 108*e*, which may be configured to perform a folding or bending operation along folding lines 210*a* and 210*b* to form a component profile 304*e*. The pass $p_4$ may then perform a further folding or bending operation along the folding lines 210*a-b* to form a component profile 304*f*. The component profile 304*f* may have a substantially reduced width that may require the pass $p_4$ to be implemented using staggered forming units such as, for example, the staggered forming units of the forming pass 108*e*. In a similar manner, a pass $p_5$ may be implemented by the forming pass 108*f* and may be configured to perform a final folding or bending operation along the folding lines 210*a* and 210*b* to complete the formation of the flanges 204*a-b* to match a component profile 304*g*. The component profile 304*g* may be substantially similar or identical to the profile of the example C-shaped component 200 of FIG. 2A. Although the C-shaped component 200 is shown as being formed by the six passes $p_0$-$p_5$, any other number of passes may be used instead.

Figure 4B:
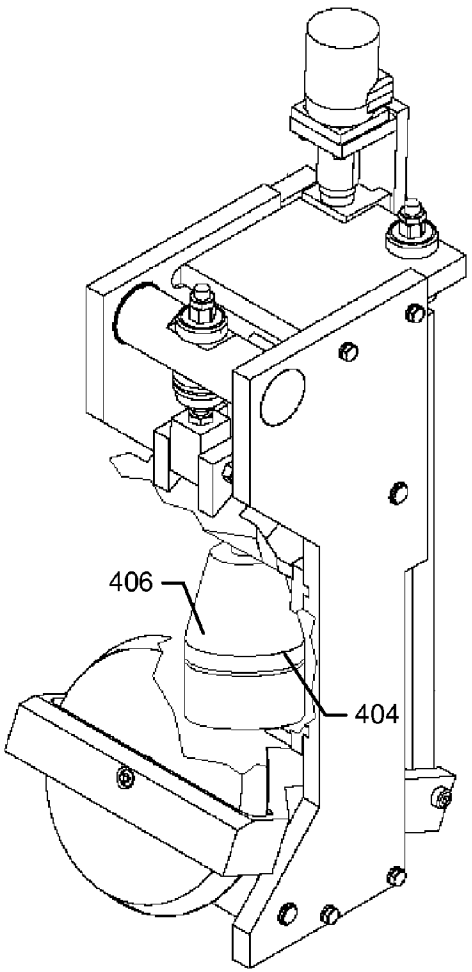
FIGS. 4A and 4B are isometric views of an example forming unit.
Figure 4A:
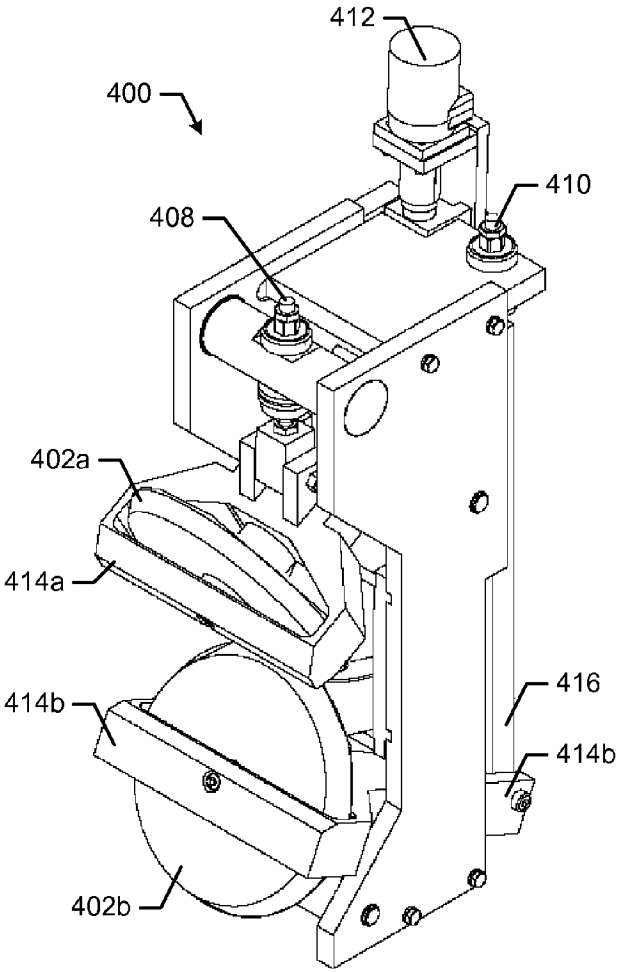

FIGS. 4A and 4B are isometric views of an example forming unit 400. The example forming unit 400 or other forming units substantially similar or identical to the example forming unit 400 may be used to implement the forming passes 108*a-g*. The example forming unit 400 is shown by way of example as having an upper side roller 402*a*, a lower side roller 402*b*, and a return or flange roller 404 (i.e., a flange roller 404) (clearly shown in FIG. 4B).

Any material capable of withstanding the forces associated with the bending or folding of a material such as, for example, steel, may be used to implement the rollers 402*a-b* and 404. The rollers 402*a-b* and 404 may also be implemented using any shape suitable for performing a desired bending or folding operation. For example, as described in greater detail below in connection with FIGS. 7A and 7B, the angle of a forming surface 406 of the flange roller 404 may be configured to form a desired structure (e.g., the return structures 202*a-b* and/or the flange structures 204*a-b*) having any desired angle.

The positions of the rollers 402*a-b* and 404 may be adjusted to accommodate, for example, different thickness materials. More specifically, the position of the upper side roller 402*a* may be adjusted by a position adjustment system 408, the position of the lower side roller 402*b* may be adjusted by a position adjustment system 410, and the position of the flange roller 404 may by adjusted by a position adjustment system 412. As shown in FIG. 4A, the position adjustment system 408 is mechanically coupled to an upper side roller support frame 414*a*. As the position adjustment system 408 is adjusted, the upper side roller support frame 414*a* causes the upper side roller 402*a* to move along a curved path toward or away from the flange roller 404. In a similar manner, the position adjustment system 410 is mechanically coupled to a lower side roller support frame 414*b* via an extension element 416 (e.g., a push rod, a link arm, etc.). As shown clearly in FIG. 5, adjustment of the position adjustment system 410 moves the extension element 416 to cause the lower side roller support frame 414*b* to swing the lower side roller 402*b* toward or away from the flange roller 404. The angle adjustment of the flange roller 404 with respect to the position adjustment system 410 is described below in connection with FIG. 5.

Figure 5:
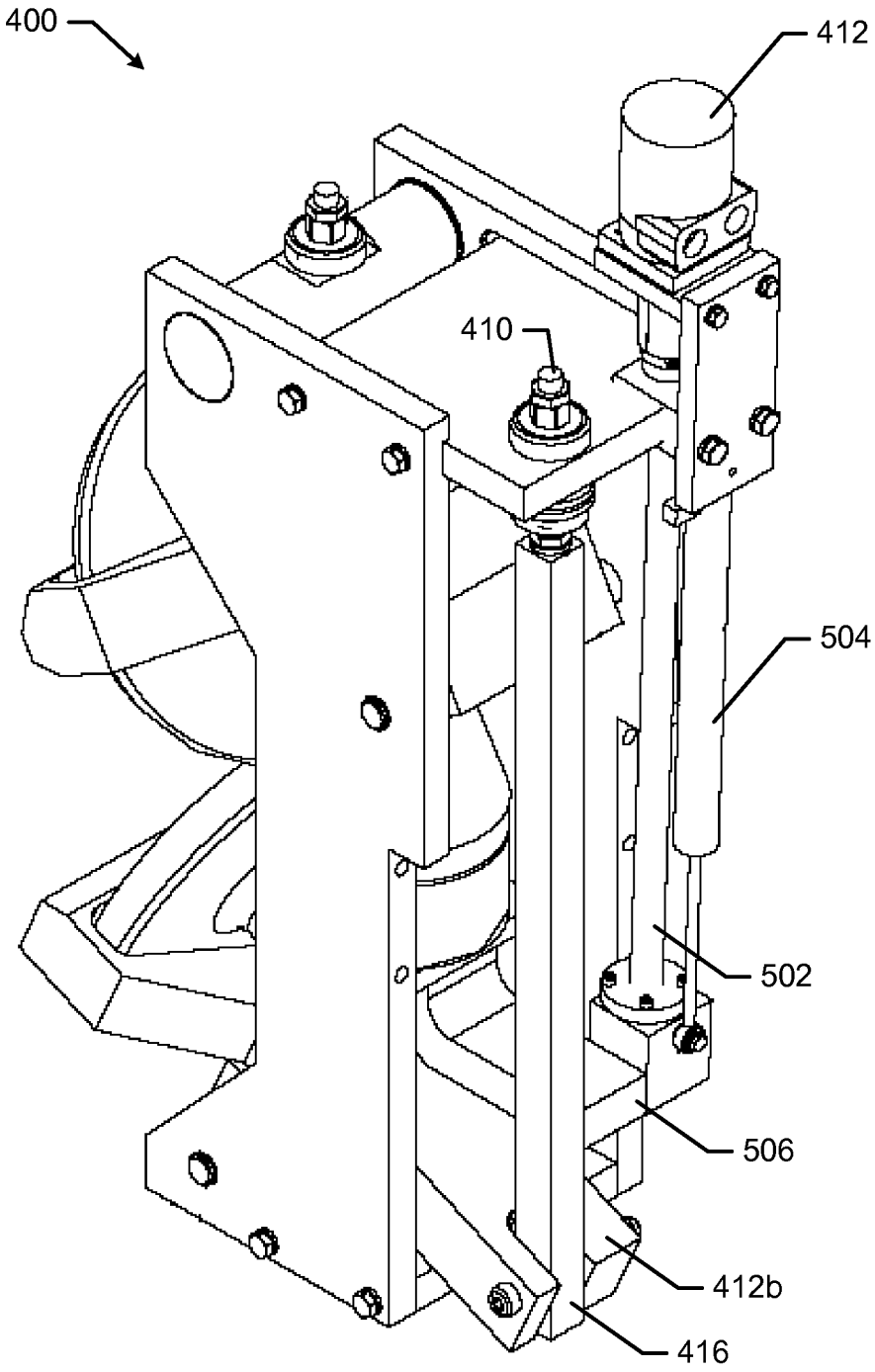
FIG. 5 is another isometric view of the example forming unit of FIGS. 4A and 4B.

FIG. 5 is another isometric view of the example forming unit 400 of FIGS. 4A and 4B. In particular, the position adjustment systems 410 and 412, the extension element 416, and the lower side roller support frame 414*b* of FIG. 4 are clearly shown in FIG. 5. The position adjustment system 412 may be mechanically coupled to an extension element 502 and a linear encoder 504. Additionally, the extension element 502 and the linear encoder 504 may also be mechanically coupled to a roller support frame 506 as shown. The position adjustment system 412, the extension element 502, and the linear encoder 504 may be used to adjust and/or measure the position or angle of the flange roller 404 as described in greater detail below in connection with FIG. 9.

In general, the position adjustment system 412 is used in a manufacturing environment to achieve a specified flare tolerance value. Flare is generally associated with the flanges of a formed component such as, for example, the example C-shaped component 200 of FIG. 2A and the example Z-shaped component 250 of FIG. 2B. As described below in connection with FIGS. 8A and 8B, flare typically occurs at the ends of formed components and may be the result of overforming or underforming. Flare may be measured in degrees by measuring an angle between a flange (e.g., the flange structures 204*a-b* of FIG. 2A) and a web (e.g., the web structure 206 of FIG. 2A). The operating angle of the return or flange roll 404 may be adjusted until, for example, the example C-shaped component 200 has an amount of flare that is within the specified flare tolerance value.

The position adjustment system 412 may be implemented using any actuation device capable of actuating the extension element 502. For example, the position adjustment system 412 may be implemented using a servo motor, a stepper motor, a hydraulic motor, a nut, a hand crank, a pneumatic piston, etc. Additionally, the position adjustment system 412 may be mechanically coupled or integrally formed with a threaded rod that screws or threads into the extension element 502. In this manner, as the position adjustment system 412 is operated (e.g., turned or rotated), the threaded rod causes the extension element 502 to extend or retract to move the roller support frame 506 to vary the angle of the flange roller 404.

The linear encoder 504 may be used to measure the distance through which the position adjustment system 412 displaces the roller support frame 506. Additionally or alternatively, the information received from the linear encoder 504 may be used to determine the angle and/or position of the flange roller 404. In any case, any device capable of measuring a distance associated with the movement of the roller support frame 506 may be used to implement the linear encoder 504.

Figure 15:
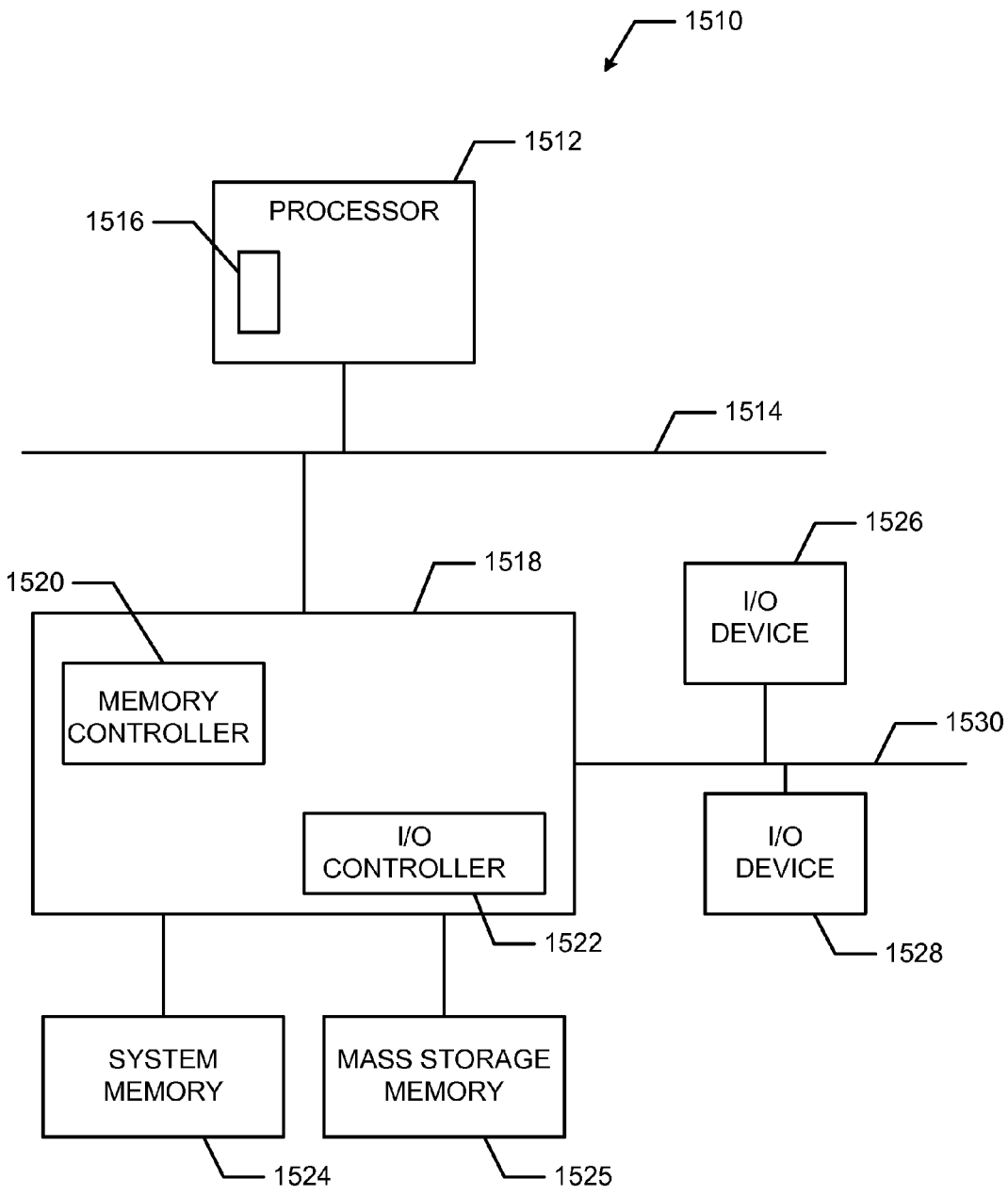
FIG. 15 is an example processor system that may be used to implement the example methods and apparatus described herein.

The linear encoder 504 may be communicatively coupled to an information processing system such as, for example, the example processor system 1510 of FIG. 15. After acquiring a measurement, the linear encoder 504 may communicate the measurement to a memory of the example processor system 1510 (e.g., the system memory 1524 or mass storage memory 1525 of FIG. 15). For example, the flange roller 404 may be configured to use one of a plurality of angle settings based on the characteristics of the material being processed. To facilitate the setup or configuration of the example forming unit 400 for a particular material, target settings or measurements associated with the linear encoder 504 may be retrieved from the mass storage memory 1525. The position adjustment system 412 may then be used to set the position of the roller support frame 504 based on the retrieved target settings or measurements to achieve a desired angle of the flange roller 404.

The position and/or angle of the flange roller 404 may be configured by hand (i.e., manually) or in an automated manner. For example, if the position adjustment system 412 includes a hand crank, an operator may turn or crank the position adjustment system 412 until the target setting(s) acquired by the linear encoder 504 matches or is substantially equal to the measurement retrieved from the mass storage memory 1525. Alternatively, if a stepper motor or servo motor is used to implement the position adjustment system 412, the example processor system 1510 may be communicatively coupled to and configured to drive the position adjustment system 412 until the measurement received from the linear encoder 504 matches or is substantially equal to the target setting(s) retrieved from the mass storage memory 1525.

Although, the position adjustment system 412 and the linear encoder 504 are shown as separate units, they may be integrated into a single unit. For example, a servo motor used to implement the position adjustment system 412 may be integrated with a radial encoder that measures the number of revolutions performed by the position adjustment system 412 to displace the roller support frame 506. Alternatively, the linear encoder 504 may be integrated with a linear actuation device such as a pneumatic piston. In this manner, the linear encoder 504 may acquire a distance or displacement measurement as the pneumatic piston extends to displace the roller support frame 506.

Figure 6:
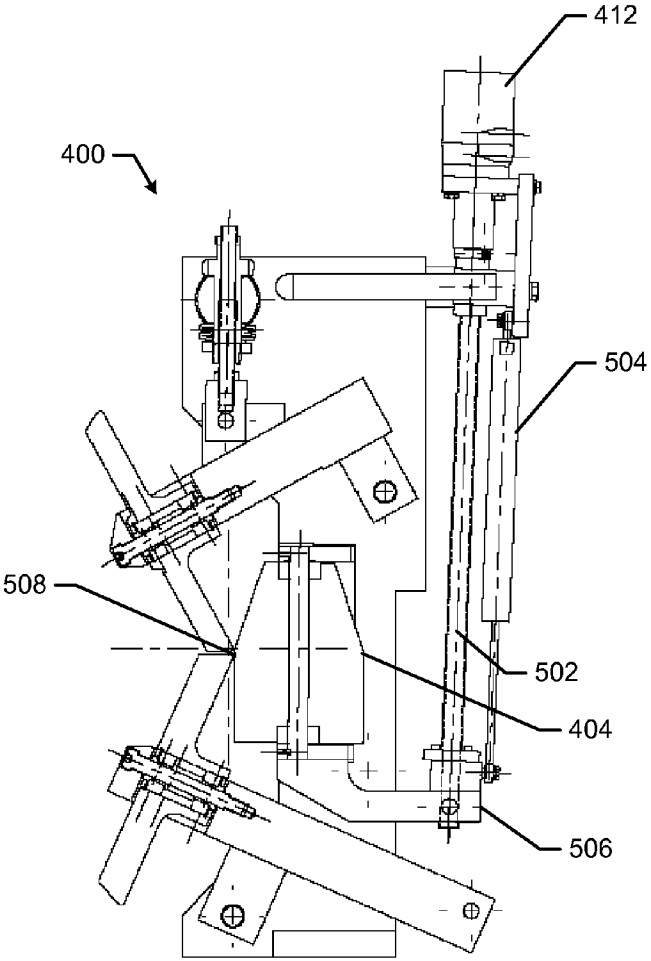
FIG. 6 is an elevational view of the example forming unit of FIGS. 4A and 4B.

FIG. 6 is an elevational view of the example forming unit 400 of FIGS. 4A and 4B. FIG. 6 clearly depicts the mechanical relationships between the flange roller 404, the position adjustment system 412 of FIG. 4A, the extension element 502, the linear encoder 504, and the roller support frame 506 of FIG. 5. When the position adjustment system 412 moves the extension element 502, the roller support frame 506 is displaced, which causes the flange roller 404 to be tilted or rotated about a pivot point 508 of the flange roller 404. The pivot point 508 may be defined by the point at which the upper side roll 402*a*, the lower side roll 402*b*, and the flange roll 404 form a fold or bend. The extension element 502 is extended until the flange roller 404 is positioned at a negative angle as depicted, for example, in a configuration at time $t_0$ 908*a* of FIG. 9. When the position adjustment system 412 retracts the extension element 502 to move the flange roller 404 about the pivot point 508, the flange roller 404 is positioned at a positive angle as depicted, for example, in a configuration at time $t_2$ 908*c* of FIG. 9.

Figure 7A:
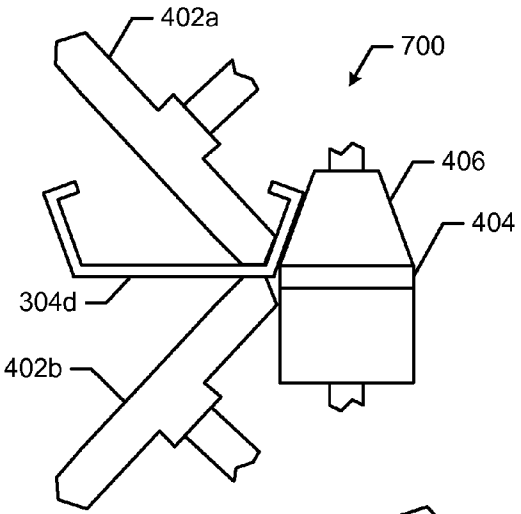
FIGS. 7A and 7B are more detailed views of roller assemblies that may be used in the example forming unit of FIGS. 4A and 4B.
Figure 7B:
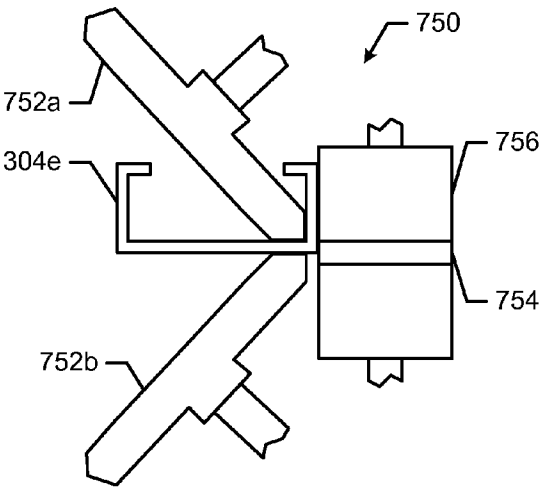

FIGS. 7A and 7B are plan views of example roller assemblies 700 and 750 of a forming unit (e.g., the forming unit 400 of FIGS. 4A and 4B). The roller assemblies 700 and 750 correspond to different forming passes of, for example, the example roll-former system 100. For example, the example roller assembly 700 may correspond to the pass $p_4$ of FIG. 3 and the example roller assembly 750 may correspond to the pass $p_5$ of FIG. 3. In particular, the example roller assembly 700 depicts the rollers 402*a-b* and 404 of FIGS. 4A and 4B in a configuration for bending or folding a material (i.e., the material 102 of FIG. 1) to form the component profile 304*d* (FIG. 3). The example roller assembly 750 depicts an upper side roller 752*a*, a lower side roller 752*b*, and a flange roller 754 having a forming surface 756. The rollers 752*a-b* and 754 may be configured to receive the material 102 from, for example, the example roller assembly 700 and perform a bending or folding operation to form the component profile 304*e* (FIG. 3).

As shown in FIGS. 7A and 7B, the forming surfaces 406 and 756 are configured to form a desired bend in the material 102 (FIG. 1). Forming surfaces of other roller assemblies of the example roll-former system 100 may be configured to have different angles to form any desired bend in the material 102. Typically, the angles of forming surfaces (e.g., the forming surfaces 406 and 756) gradually increase in successive forming passes (e.g., the forming passes 108*a-g* of FIG. 1) so that as the material 102 passes through each of the forming passes 108*a-g*, the material 102 is gradually bent or folded to form a desired final profile as described above in connection with FIG. 3.

Figure 8A:
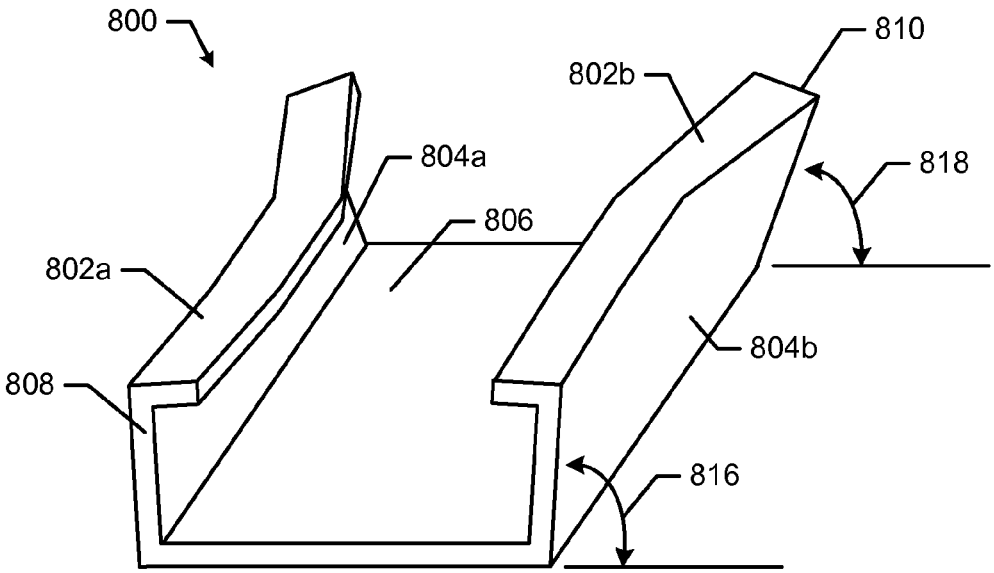
FIG. 8A is an isometric view and FIGS. 8B and 8C are plan views of example C-shaped components having underformed and/or overformed ends.
Figure 8B:
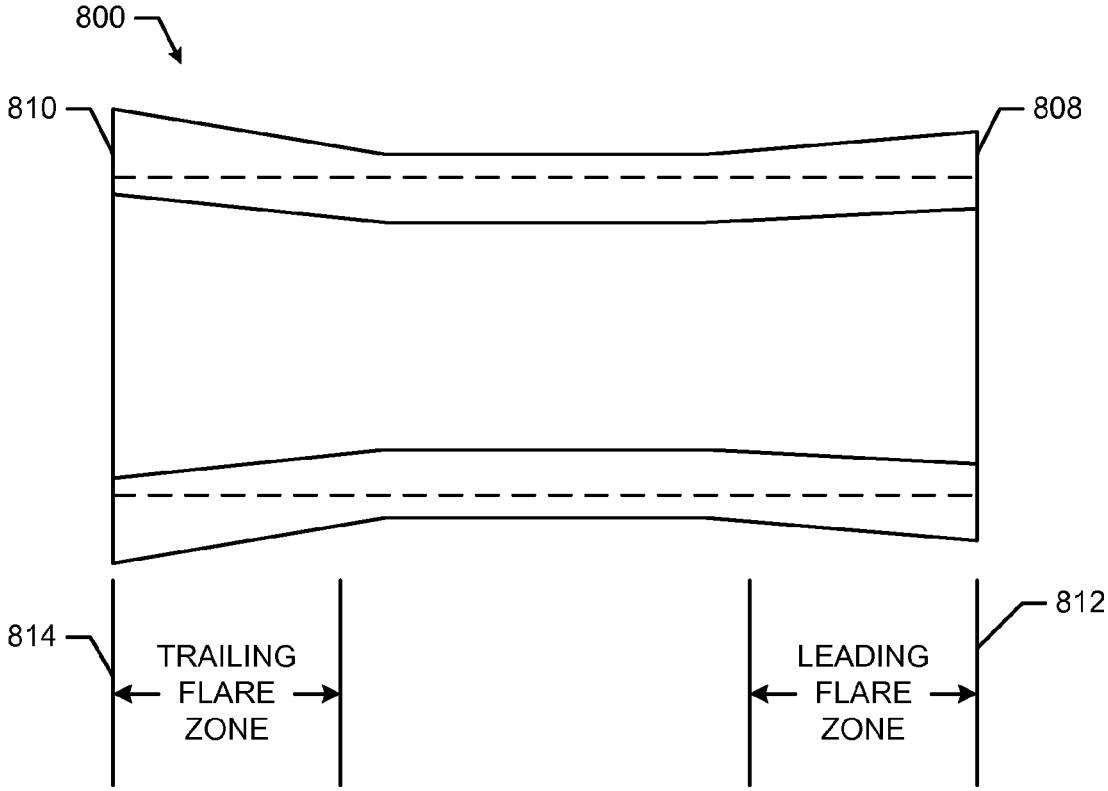
Figure 8C:
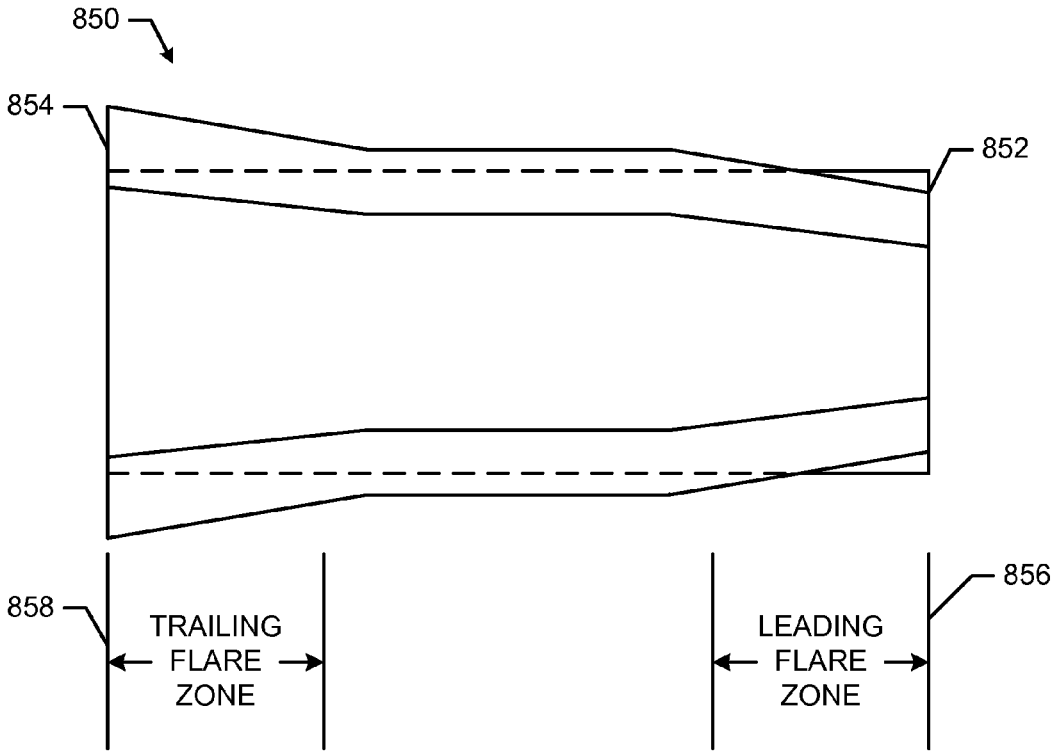

FIG. 8A is an isometric view and FIGS. 8B and 8C are plan views of example C-shaped components having underformed ends (i.e., flared-out ends) and/or overformed ends (i.e., flared-in ends). In particular, FIG. 8A is an isometric view and FIG. 8B is a plan view of an example C-shaped component 800 having underformed ends (i.e., flared-out ends). The example C-shaped component 800 includes return structures 802*a* and 802*b*, flange structures 804*a* and 804*b*, a web structure 806, a leading edge 808, and a trailing edge 810. In a C-shaped component such as the example C-shaped component 800, flared ends are typically associated with the flange structures 804*a-b*. However, flare may also occur in the return structures 802*a-b*.

Flare typically occurs at the ends of formed components and may be the result of overforming or underforming, which may be caused by roller positions and/or varying material properties. In particular, spring or yield characteristics of a material (i.e., the material 102 of FIG. 1A) may cause the flange structures 804*a-b* to flare out or to be underformed upon exiting a forming pass (e.g., one of the forming passes 108*a-g* of FIG. 1). Overform or flare-in, typically occurs when a formed component (e.g., the example C-shaped component 800) travels into a forming pass and forming rolls (e.g., the flange roll 404 of FIG. 4) overform, for example, the flange structures 804*a-b* as the example C-shaped component 800 is aligned with the forming rolls. In general, flare may be measured in degrees by determining the angle between the one or more of the flange structures 804*a-b* and the web structure 806 at both ends of a formed component (i.e., the leading end 808 and trailing end 810).

As shown in FIG. 8B, the example C-shaped component 800 includes a leading flare zone 812 and a trailing flare zone 814. The amount of flare associated with the leading flare zone 812 may be measured as shown in FIG. 8A by determining the measurement of a leading flare angle 816. Similarly, the amount of flare in the trailing flare zone 814 may be measured by determining the measurement of a trailing flare angle 818. Flare is typically undesirable and needs to be less than or equal to a flare tolerance or specification value. To reduce flare, the angle of the return or flange roll 404 of FIG. 2A and/or the return or flange roll 854 of FIG. 8B may be adjusted as described below in connection with FIG. 9.

FIG. 8C is a plan view of another example C-shaped component 850 having an overformed leading end 852 (i.e., a flared-in end) and an underformed trailing end 854 (i.e., a flared-out end). As shown in FIG. 8C, flare-in typically occurs along the length of a leading flare zone 856 and flare-out typically occurs at a trailing flare zone 858. As described above, flare-in may occur when a formed component (e.g., the example C-shaped component 800) travels into a forming pass and forming rolls (e.g., the flange roll 404 of FIG. 4) overform, for example, the flange structures 804*a-b* until the example C-shaped component 800 is aligned with the forming rolls. This typically results in a formed component that is substantially similar or identical to the example C-shaped component 850. Although, the example methods and apparatus described herein are described with respect to the example C-shaped component 800, it would be obvious to one of ordinary skill in the art that the methods and apparatus may also be applied to the example C-shaped component 850.

Figure 9:
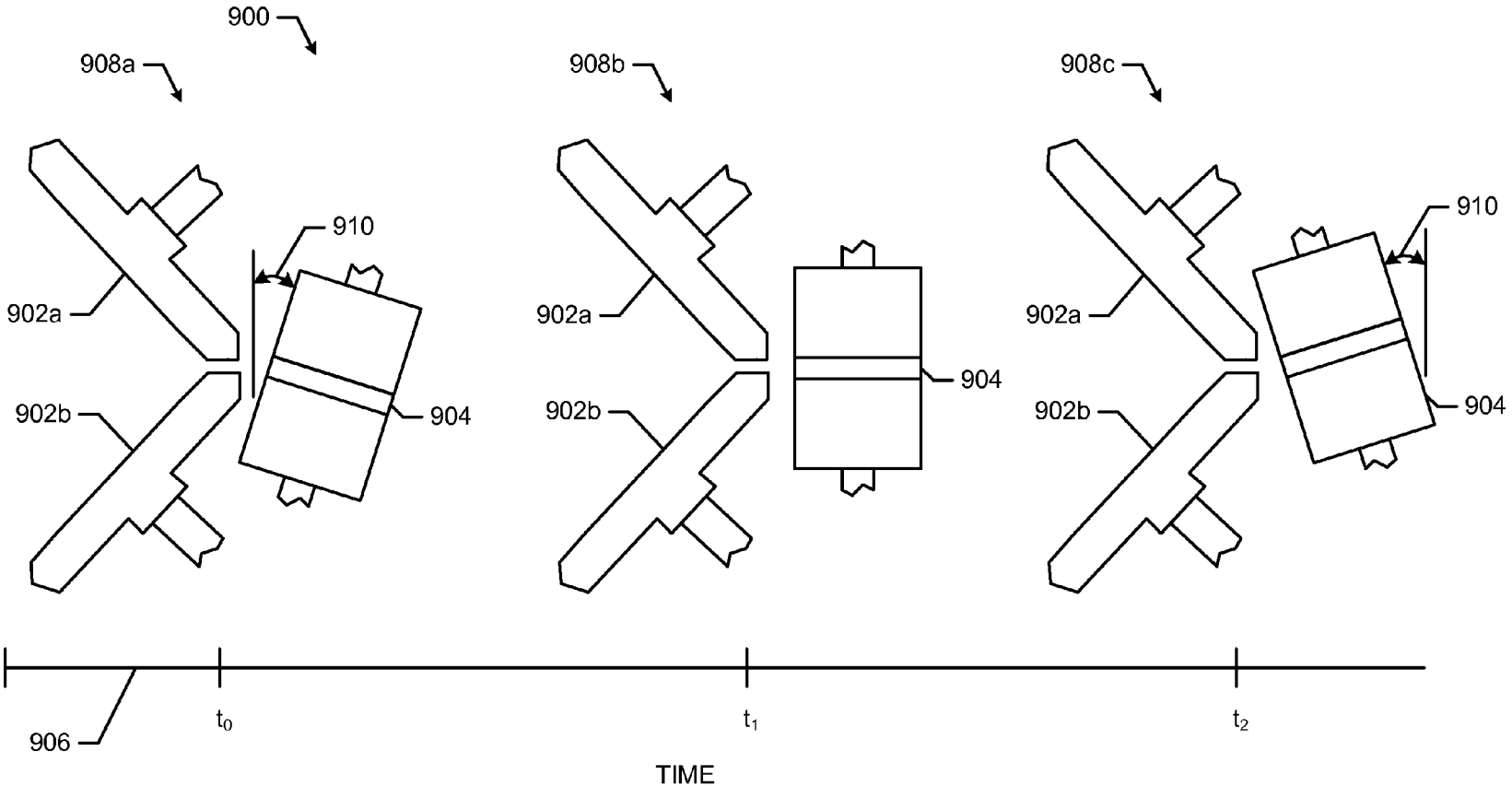
FIG. 9 is an example time sequence view depicting the operation of a flange roller.

FIG. 9 is an example time sequence view 900 depicting the operation of a flange roller (e.g., the flange roller 404 of FIG. 4B). In particular, the example time sequence 900 shows the time varying relationship between two rollers 902*a* and 902*b* and a flange roller 904 during operation of the example roll-former system 100 (FIG. 1). As shown in FIG. 9, the example time sequence 900 includes a time line 906 and depicts the rollers 902*a-b* and 904 at several times during their operation. More specifically, the rollers 902*a-b* and 904 are depicted in a sequence of configurations indicated by a configuration 908*a* at time $t_0$, a configuration 908*b* at time $t_1$, and a configuration 908*c* at time $t_2$. An angle 910 of the flange roller 904 is adjusted to control the flare of a profiled component (i.e., the example C-shaped component 800 of FIGS. 8A and 8B) as a material (e.g., the material 102 of FIG. 1) travels through the rollers 902*a-b* and 904. The flange roller 904 may be repositioned via, for example, the position adjustment system 412, the extension element 502, and the roller support frame 506 as described above in connection with FIG. 5.

The rollers 902*a-b* and 904 may be used to implement a final forming pass of the example roll-former system 100 (FIG. 1) such as, for example, the forming pass 108*g*. The final forming pass 108*g* may be configured to receive the example C-shaped component 800 of FIGS. 8A and 8B while the rollers 902*a-b* and 904 are configured as indicated by the configuration at time $t_0$ 908*a*. Alternatively, the final forming pass 108*g* may be configured to receive the example C-shaped component 850 of FIG. 8C. In this case, the roller 902*a* applies an outward force to one of the overformed flanges of the leading flare zone 856, thus causing the overformed flange to move toward the surface of the flange roller 904 that is positioned at a negative angle as shown by the configuration at time $t_0$ 908*a*. In this manner, an overformed flange may be pushed out toward a nominal flange position.

After the forming pass 108*g* receives the leading flare zone 812 (FIG. 8B) and the example C-shaped component 800 travels through the forming unit 108*g*, the flange roller 904 may be repositioned so that the angle 910 is reduced from a negative angle value to a nominal angle value or substantially equal to zero. The flange roller 904 is positioned according to the configuration at time $t_1$ 908*b* when the angle 910 is substantially equal to a nominal angle value or substantially equal to zero. As the example C-shaped component 800 continues to move through the forming process, the trailing flare zone 814 enters the forming pass 108*g* and the flange roller 904 is further repositioned toward a positive angle as shown by the configuration at time $t_2$ 908*c*.

The position or angle of the flange roller 904 may be measured by the linear encoder 504, which may provide distance measurements to a processor system such as, for example, the example processor system 1510 of FIG. 15. The example processor system 1510 may then control the position adjustment system 412 of FIGS. 4 through 6. Although, the flange roller 904 is shown as having a cylindrical forming surface profile, any type of forming profile may be used such as, for example, a tapered profile substantially similar or identical to that depicted in connection with the return or forming roller 404 of FIGS. 4A and 4B.

Figure 10:
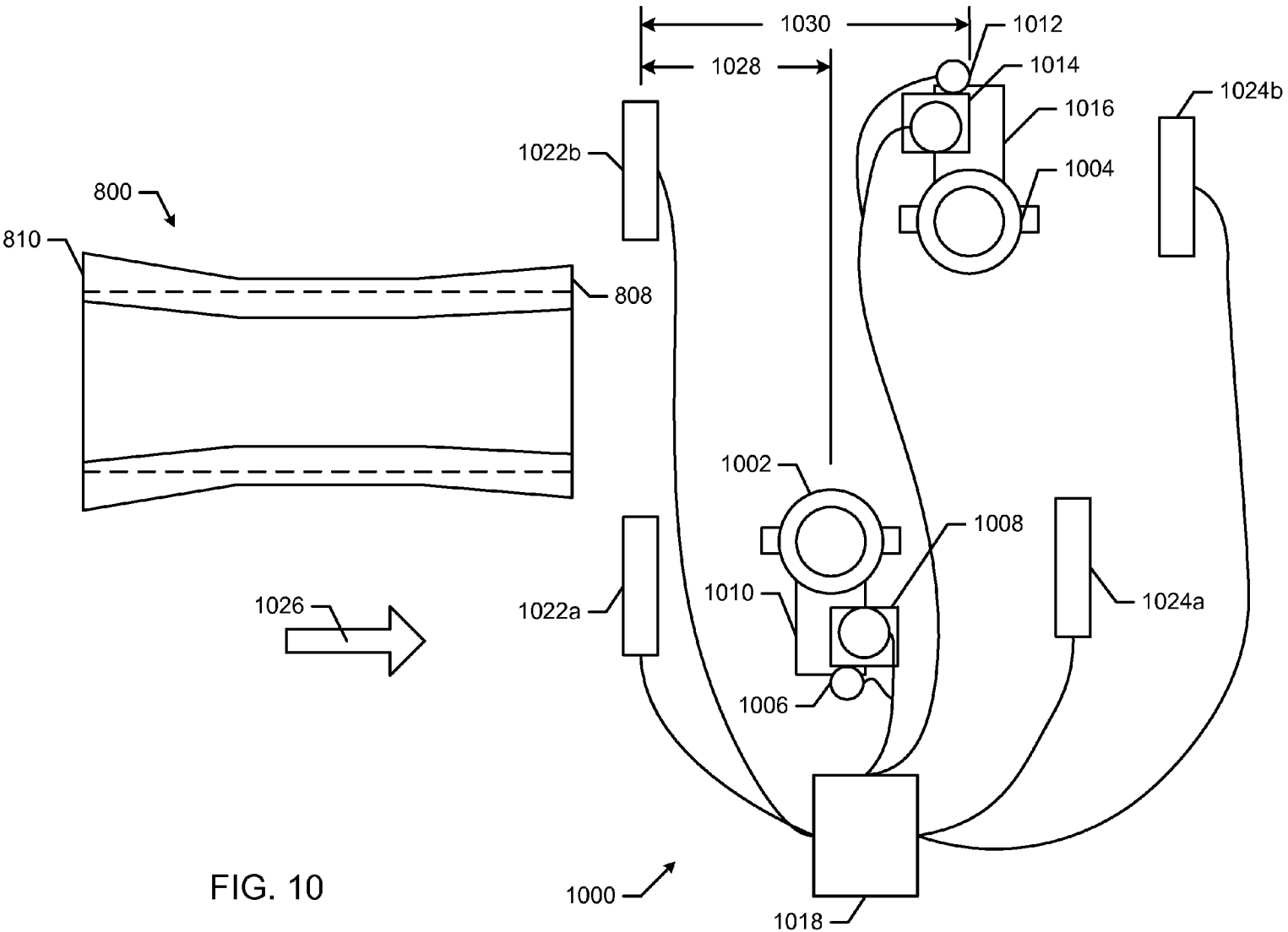
FIG. 10 is a plan view of an example flare control system that may be used to control the flare associated with a roll-formed component.

FIG. 10 depicts an example flare control system 1000 that may be used to control the flare associated with a component (e.g., the C-shaped component 200 of FIG. 2A and/or the Z-shaped component 250 of FIG. 2B). The example flare control system 1000 may be used to control flare in formed components having any desired profile. However, for purposes of clarity, the example C-shaped component 800 is shown in FIG. 10. The example flare control system 1000 may be integrated within the example roll-former system 100 of FIG. 1 or may be a separate system. For example, if the example flare control system 1000 is integrated within the example roll-former system 100, it may be implemented using the forming pass 108*g*.

The example flare control system 1000 includes an operator side flange roller 1002 and a drive side flange roller 1004. The operator side flange roller 1002 and the drive side flange roller 1004 may be integrated within the example roll-former system 100 (FIG. 1). The flange rollers 1002 and 1004 may be substantially similar or identical to the flange roller 756 of FIG. 7B or any other flange roller described herein. As is known, the operator side of the example roll-former system 100 is the side associated with an operator (i.e., a person) running the system. The drive side of the example roll-former system 100 is the side that is typically furthest from the operator or opposite the operator side.

The example flare control system 1000 may be configured to tilt, pivot, or otherwise position the drive side flange roller 1004 and the operator side flange roller 1002, as described above in connection with FIG. 9, while the example C-shaped component 800 moves past the rollers 1002 and 1004. Varying an angle (e.g., the angle 910 of FIG. 9) associated with a position of the flange rollers 1002 and 1004 enables the example flare control system 1000 to control the amount of flare at both ends of the example C-shaped component 800. For example, as shown in FIG. 8A, the leading flare angle 816 is smaller than the trailing flare angle 818. If the flange rollers 1002 and 1004 were held in one position as the example C-shaped component 800 passed through, one of the flanges (e.g., one of the flanges 804*a* and 804*b* of FIG. 8A) may be underformed or overformed. By tilting or pivoting the flange rollers 1002 and 1004 while the material (e.g., the example C-shaped component 800) is moving through the example flare control system 1000, each of the flanges can be individually conditioned via a different pivot or angle setting and variably conditioned along the length of the corresponding flare zones 812 and 814.

The operator side flange roller 1002 is mechanically coupled to a first linear encoder 1006 and a first position adjustment system 1008 via a first roller support frame 1010. Similarly, the drive side flange roller 1004 is mechanically coupled to a second linear encoder 1012 and a second position adjustment system 1014 via a second roller support frame 1016. The linear encoders 1006 and 1012, the position adjustment systems 1008 and 1014, and the roller support frames 1010 and 1016 may be substantially similar or identical to the linear encoder 504 (FIG. 5), the position adjustment system 412 (FIG. 4), and the roller support frame 506 (FIG. 5), respectively. Additionally, the position adjustment systems 1008 and 1014 and the linear detectors 1006 and 1012 may be communicatively coupled to a processor system 1018 as shown. The example processor system 1018 may be substantially similar or identical to the example processor system 1510 of FIG. 15.

The example processor system 1018 may be configured to drive the position adjustment systems 1008 and 1014 and change positions of the flange rollers 1002 and 1004 via the roller support frames 1010 and 1016. As the roller support frames 1010 and 1016 move, the linear detectors 1006 and 1012 may communicate a displacement value to the example processor system 1018. The example processor system 1018 may then use the displacement value to drive the flange rollers 1002 and 1004 to appropriate positions (e.g., angles).

The example processor system 1018 may also be communicatively coupled to an operator side component sensor 1022*a*, and a drive side component sensor 1022*b*, an operator side feedback sensor 1024*a*, and a drive side feedback sensor 1024*b*. The component sensors 1022*a-b* may be used to detect the leading edge 808 of the example C-shaped component 800 as the example C-shaped component 800 moves toward the flange rollers 1002 and 1004 in a direction generally indicated by the arrow 1026. Additionally, the component sensors 1022*a-b* may be configured to measure an amount of flare associated with, for example, the flange structures 804*a-b* (FIG. 10) in a continuous manner as the example C-shaped component 800 travels through the example flare control system 1000 as described in detail below in connection with the example method of FIG. 12. The flare measurements may be communicated to the example processor system 1018, which may then control the positions (i.e., the angle 910 shown in FIG. 9) of the flange rollers 1002 and 1004 in a continuous manner in response to the flare measurements to reduce, modify, or otherwise control the flare associated with the example C-shaped component 800.

Although the functionality to detect a leading edge and the functionality to measure an amount of flare are shown as integrated in each of the component sensors 1022*a-b*, the functionalities may be provided by separate sensors. In other words, the functionality to detect a leading edge may be implemented by a first set of sensors and the functionality to measure an amount of flare may be implemented by a second set of sensors. Additionally, the functionality to detect a leading edge may be implemented by a single sensor.

The component sensors 1022*a-b* may be implemented using any sensor suitable for detecting the presence of a formed component such as, for example, the C-shaped component 800 (FIG. 8) and measuring flare of the formed component. In one example, the component sensors 1022*a-b* may be implemented using a spring-loaded sensor having a wheel that contacts (e.g., rides on), for example, the flange structures 804*a-b* (FIG. 8). The spring loaded sensor may include a linear voltage displacement transducer (LVDT) that measures a displacement of the flange structures 804*a-b* in a continuous manner as the example C-shaped component 800 travels through the example flare control system 1000 (FIG. 10). The example processor system 1018 may then determine a flare measurement value based on the displacement measured by the LVDT. Alternatively, the component sensors 1022*a-b* may be implemented using any other sensor that may be configured to measure flare along the length of a formed component (e.g., the example C-shaped component 800) as it moves through the example flare control system 1000 such as, for example, an optical sensor, a photodiode, a laser sensor, a proximity sensor, an ultrasonic sensor, etc.

The component sensors 1022*a-b* may be configured to alert the example processor system 1018 when the leading edge 808 is detected. The example processor system 1018 may then drive the positions of the flange rollers 1002 and 1004 in response to the alert from the component sensors 1022*a-b*. More specifically, the example processor system 1018 may be configured to determine when the leading edge 808 reaches the flange rollers 1002 and 1004 based on a detector to operator side flange roller distance 1028 and a detector to drive side flange roller distance 1030. For example, the example processor system 1018 may detect when the leading edge 808 reaches the flange rollers 1002 and 1004 based on mathematical calculations and/or a position encoder.

Using mathematical calculations, the example processor system 1018 may determine the time (e.g., elapsed time) required for the leading edge 808 to travel from the component sensors 1022*a-b* to the operator side flange roller 1002 and/or the drive side flange roller 1004. These calculations may be based on information received from the component sensors 1022*a-b*, the detector to operator side flange roller distance 1028, a velocity of the example C-shaped component 800, and a timer. For example, the component sensors 1022*a-b* may alert the example processor system 1018 that the leading edge 808 has been detected. The example processor system 1018 may then determine the time required for the leading edge 808 to reach the operator side flange roller 1002 by dividing the detector to operator side flange roller distance 1028 by the velocity of the example C-shaped component 800 (i.e., time (seconds)=length (inches)/velocity (inches/seconds)). Using a timer, the example processor system 1018 may then compare the time required for the leading edge to travel from the component sensors 1022*a-b* to the operator side flange roller 1002 to the value of a timer to determine when the leading edge 808 reaches the operator side flange roller 1002. The time (e.g., elapsed time) required for the leading edge 808 to reach the drive side flange roller 1004 may be determined in the same manner based on the detector to drive side flange roller distance 1030.

In a similar manner, the example processor system 1018 may detect when any location on the example C-shaped component 800 reaches the flange rollers 1002 and 1004. For example, the example processor system 1018 may determine when the end of the leading flare zone 812 reaches the operator side flange roller 1002 by adding the detector to operator side flange roller distance 1028 to the length of the leading flare zone 812.

Alternatively, determining when any location on the example C-shaped component 800 reaches the flange rollers 1002 and 1004 may be accomplished based on a position encoder (not shown). For example, a position encoder may be placed in contact with the example C-shaped component 800 or a drive mechanism or component associated with driving the C-shaped component towards the flange rollers 1002 and 1004. As the example C-shaped component 800 moves toward the flange rollers 1002 and 1004, the position encoder measures the distance traversed by the example C-shaped component 800. The distance traversed by the example C-shaped component 800 may then be used by the example processor system 1018 to compare to the distances 1028 and 1030 to determine when the leading edge 808 reaches the flange rollers 1002 and 1004.

The feedback sensors 1024*a-b* may be configured to measure an amount of flare of the example C-shaped component 800 as the C-shaped component moves away from the flange rollers 1002 and 1004 in a direction generally indicated by the arrow 1026. The feedback sensors 1024*a-b* may be implemented using any sensor or detector capable of measuring an amount of flare associated with the example C-shaped component 800. For example, the feedback sensors 1024*a-b* may be implemented using a machine vision system, a photodiode, a laser sensor, a proximity sensor, an ultrasonic sensor, etc.

The feedback sensors 1024*a-b* may be configured to communicate measured flare values to the example processor system 1018. The example processor system 1018 may then use the measured flare values to adjust the position of the flange rollers 1002 and 1004. For example, if the measured flare values are greater than a flare tolerance or specification, the positions of the flange rollers 1002 and 1004 may be adjusted to increase the angle 910 shown in the configuration at time $t_2$ 908*c* so that the flare of the next formed component may be reduced to meet the desired flare tolerance or specification.

Figure 11:
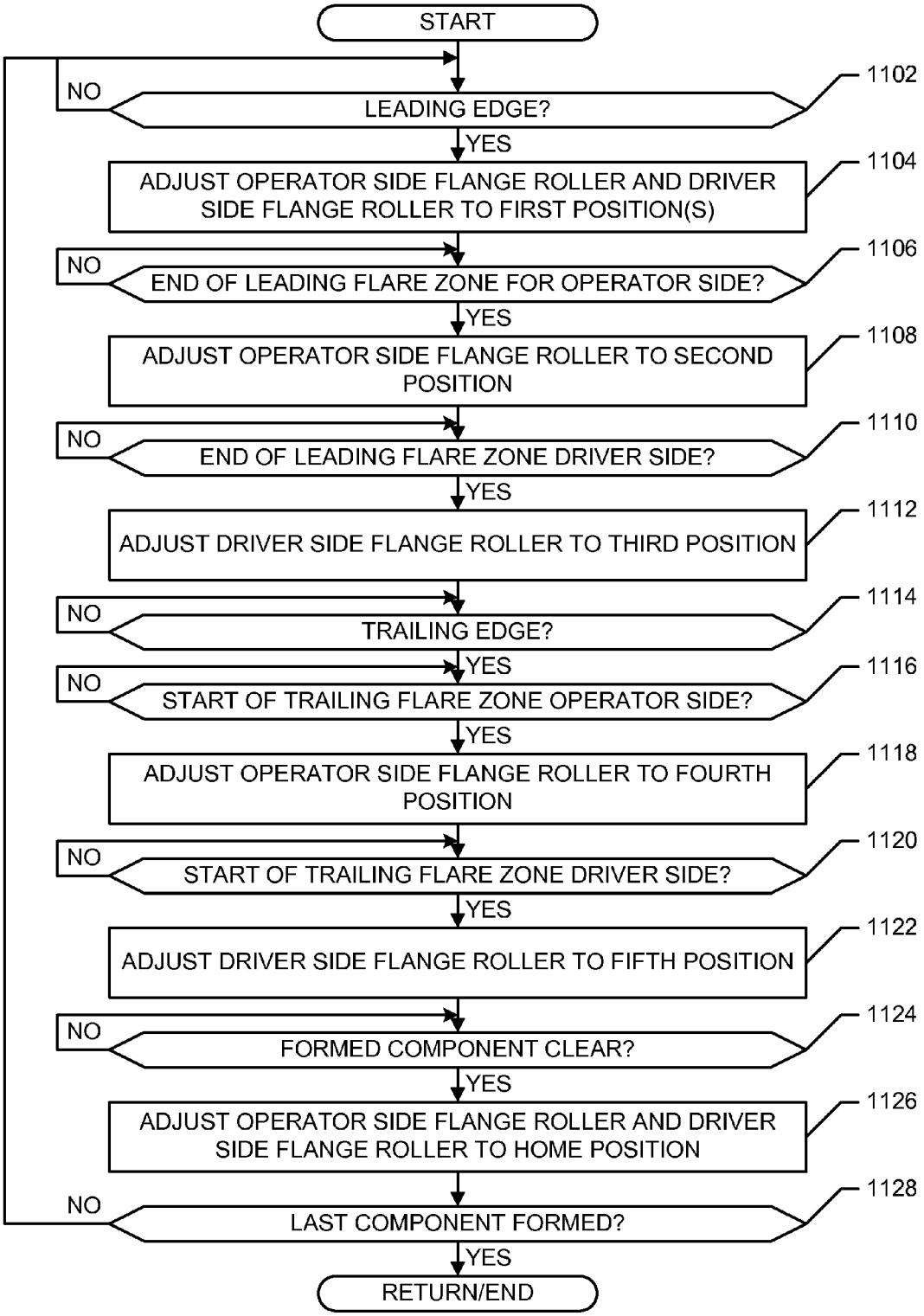
FIG. 11 is a flow diagram depicting an example manner in which the example flare control system of FIG. 10 may be configured to control the flare of a formed component.

FIG. 11 is a flow diagram depicting an example manner in which the example flare control system 1000 of FIG. 10 may be configured to control the flare of a formed component (e.g., the example C-shaped component 800 of FIGS. 8A and 8B). In general, the example method may control flare in the example C-shaped component 800 by varying the positions of a drive side flange roller (e.g., the drive side flange roller 1004 of FIG. 10) and an operator side flange roller (e.g., the operator side flange roller 1002 of FIG. 10), as described above, in response to the location of the C-shape component 800 within the example flare control system 1000.

Initially, the example method determines if a leading edge (e.g., the leading edge 808 of FIG. 8) is detected (block 1102). The detection of the leading edge 808 may be performed by, for example, the component sensors 1022*a-b*. The detection of the leading edge 808 may be interrupt driven or polled. If the leading edge 808 is not detected, the example method may remain at block 1102 until the leading edge 808 is detected. If the leading edge 808 is detected at block 1102, the operator side flange roller 1002 and the drive side flange roller 1004 are adjusted to a first position or respective first positions (block 1104). The first positions of the flange rollers 1002 and 1004 may be substantially similar or identical to the position of the flange roller 904 of the configuration at time $t_0$ 908*a* as depicted in FIG. 9. However, in some instances the first position of the flange rollers 1002 and 1004 may not be identical to accommodate material variations (i.e., variation in the material being formed) and/or variations in the roll-forming equipment.

It is then determined if the end of a leading flare zone (e.g., the leading flare zone 812) has reached the operator side flange roller 1002 (block 1106). An operation for determining when the end of the leading flare zone 812 reaches the operator side flange roller 1002 may be implemented as described above in connection with FIG. 10. If it is determined at block 1106 that the end of the leading flare zone 812 has not reached the operator side flange roller 1002, the example method may remain at block 1106 until the end of the leading flare zone 812 is detected. However, if the end of the leading flare zone 812 has reached the operator side flange roller 1002, the operator side flange roller 1002 is adjusted to a second position (block 1108). The second position of the operator side flange roller 1002 may be substantially similar or identical to the position of the flange roller 904 of the configuration 908*b* at time $t_1$ as depicted in FIG. 9.

The example method then determines if the end of the leading flare zone 812 has reached the drive side flange roller 1004 (block 1110). If it is determined at block 1110 that the end of the leading flare zone 812 has not reached the drive side flange roller 1004, the example method may remain at block 1110 until the end of the leading flare zone 812 is detected. However, if the end of the leading flare zone 812 has reached the drive side flange roller 1004, the drive side flange roller 1004 is adjusted to a third position (block 1112). The third position of the drive side flange roller 1002 may be substantially similar or identical to the position of the flange roller 904 of the configuration 908*b* at time $t_1$ as depicted in FIG. 9.

It is then determined if the trailing edge 810 has been detected (block 1114). The trailing edge 810 may be detected using, for example, the component sensors 1022*a-b* of FIG. 10 using a polled and/or interrupt-based method. Detecting the trailing edge 812 may be used to determine if the trailing flare zone 814 is in proximity of the flange rollers 1002 and 1004. Detecting the trailing edge 810 may be used in combination with, for example, a method associated with a position encoder and a known distance as described above in connection with FIG. 10 to determine if the trailing flare zone 814 has reached the proximity of the flange rollers 1002 and 1004. Alternatively, the detection of the leading edge 808 at block 1102 and a distance or length associated with the leading edge 808 and the beginning of the trailing flare zone 814 may be used to determine if the trailing flare zone 814 has reached the proximity of the flange rollers 1002 and 1004. If it is determined at block 1114 that the trailing edge 810 has not been detected, the example method may remain at block 1114 until the trailing edge 810 is detected. On the other hand, if the trailing edge 810 is detected, it is determined if the start of the trailing flare zone 814 has reached the operator side (block 1116).

If it is determined that the start of the trailing flare zone 814 has not reached the operator side flange roller 1002, the example method may remain at block 1116 until the start of the trailing flare zone 814 reaches the operator side flange roller 1002. If it is determined at block 1116 that the start of the trailing flare zone 814 has reached the operator side flange roller 1002, the operator side flange roller 1002 is adjusted to a fourth position (block 1118). The fourth position of the operator side flange roller 1002 may be substantially similar or identical to the position of the flange roller 904 of the configuration 908*c* at time $t_2$ as depicted in FIG. 9.

The example method may then determine if the start of the trailing flare zone 814 has reached the drive side flange roller 1004 (block 1120). If the start of the trailing flare zone 814 has not reached the drive side flange roller 1004, the example method may remain at block 1120 until the start of the trailing flare zone 814 has reached the drive side flange roller 1004. On the other hand, if the start of the trailing flare zone 814 has reached the drive side flange roller 1004, the drive side flange roller 1004 is adjusted to a fifth position (block 1122). The fifth position of the drive side flange roller 1004 may be substantially similar or identical to the position of the flange roller 904 of the configuration 908*c* at time $t_2$ as depicted in FIG. 9.

The example method then determines if the example C-shaped component 800 is clear (block 1124). The feedback sensor 1024*a-b* (FIG. 10) may be used to detect if the example C-shaped component 800 is clear. If it is determined at block 1124 that the example C-shaped component 800 is not clear, the example method may remain at block 1124 until the example C-shaped component 800 is clear. If the example C-shaped component 800 is clear, the flange rollers 1002 and 1004 are adjusted to a home position (block 1126). The home position may be any position in which the flange rollers 1002 and 1004 can be idle (e.g., the first positions described above in connection with block 1104). It is then determined if the last component has been formed (block 1128). If the last component has been formed, the process returns or ends. If the last component has not been formed, control is passed back to block 1102.

Flare is typically manifested in a formed component (e.g., the example C-shaped component 800) in a gradual or graded manner from a first location on the formed component (e.g., the leading edge 808 shown in FIG. 8) to a second location on the formed component (e.g., the end of the leading flare zone 812 shown in FIG. 8). The positions of the flange rollers 1002 and 1004 may be changed based on various component parameters such as, for example, the gradient of flare in a flare zone (e.g., the leading flare zone 812 and/or the trailing flare zone 814), the length of the flare zone, and the velocity of the example C-shaped component 800 (FIG. 8). Additionally, various parameters associated with moving the flange rollers 1002 and 1004 may be varied to accommodate the component parameters such as, for example, a flange roller velocity, a flange roller ramp rate, and a flange roller acceleration. The flange roller velocity may be used to control the velocity at which the flange rollers 1002 and 1004 move from a first position to a second position.

For example, the operator side flange roller 1002 may be adjusted gradually over time from a first position at block 1104 to a second position at block 1108 as the example C-shaped component 800 travels through the example flare control system 1000. The movement of the operator side flange roller 1002 from the first position to the second position may be configured by setting, for example, the flange roller velocity, the flange roller ramp rate, and the flange roller acceleration based on the gradient of the leading flare zone 812 and/or the trailing flare zone 814, the length of one or both of the flare zones 812 and 814, and the velocity of the example C-shaped component 800. As the example C-shaped component 800 travels through the example flare control system 1000 (FIG. 10), the position of the operator side flange roller 1002 may move gradually from a first position to a second position to follow a gradient of flare.

More specifically, with respect to the example method of FIG. 11, after detecting the leading edge 808, the position of the operator side flange roller 1002 may be adjusted to a first position (block 1104). When the leading edge 808 reaches or is in proximity of the operator side flange roller 1002, the position of the operator side flange roller 1002 may begin to change or adjust from the first position to a second position and will adjust gradually for an amount of time required for the end of the leading flare zone 812 (FIG. 8) (e.g., time (seconds)=length of the example C-shaped component 800 (inches)/velocity of the example C-shaped component 800 (inches/second)) to reach or to be in proximity to the operator side flange roller 1002. When the end of the leading flare zone 812 (FIG. 8) reaches or is in proximity to the operator side flange roller 1002 as determined at block 1106, the operator side flange roller 1002 is at the second position described in connection with block 1108. It will be apparent to one of ordinary skill in the art that the methods described above for adjusting the operator side flange roller 1002 may be used to adjust the driver side flange roller 1004 and may be used to control flare at any position or location along the length of a formed component such as, for example, the example C-shaped component 800.

The position values (e.g., angle settings) for the flange rollers 1002 and 1004 described in connection with the example method of FIG. 11 may be determined by moving one or more formed components such as, for example, the example C-shaped component 800 through the example flare control system 1000 and adjusting the positions of the flange rollers 1002 and 1004 until the measured flare is within a flare tolerance specification value. More specifically, the positions may be determined by setting the flange rollers 1002 and 1004 to a position, moving the example C-shaped component 800 or a portion thereof (e.g., one of the flare zones 812 and 814) through the example flare control system 1000, measuring the flare of the example C-shaped component 800, and re-positioning the flange rollers 1002 and 1004 based on the measured flare. This process may be repeated until the measured flare is within a flare tolerance specification value. Additionally, this process may be performed for any flared portion of the example C-shaped component 800.

The position values (e.g., angle settings) for the flange rollers 1002 and 1004 may be stored in a memory such as, for example, the mass storage memory 1525. More specifically, the position values may be stored in, for example, a database and retrieved multiple times during operation of the example method. Additionally, a plurality of profiles may be stored for a plurality of material types, thicknesses, etc. that may be used in, for example, the example roll-former system 100 of FIG. 1. For example, a plurality of sets of position values may be predetermined for any number of different materials having different material characteristics. Each of the position value sets may then be stored as a profile in a database entry and referenced using material identification information. During execution of the example method of FIG. 11, an operator may inform the example processor system 1018 of the material that is being used and the example processor system 1018 may retrieve the profile or position value set associated with the material.

Figure 12:
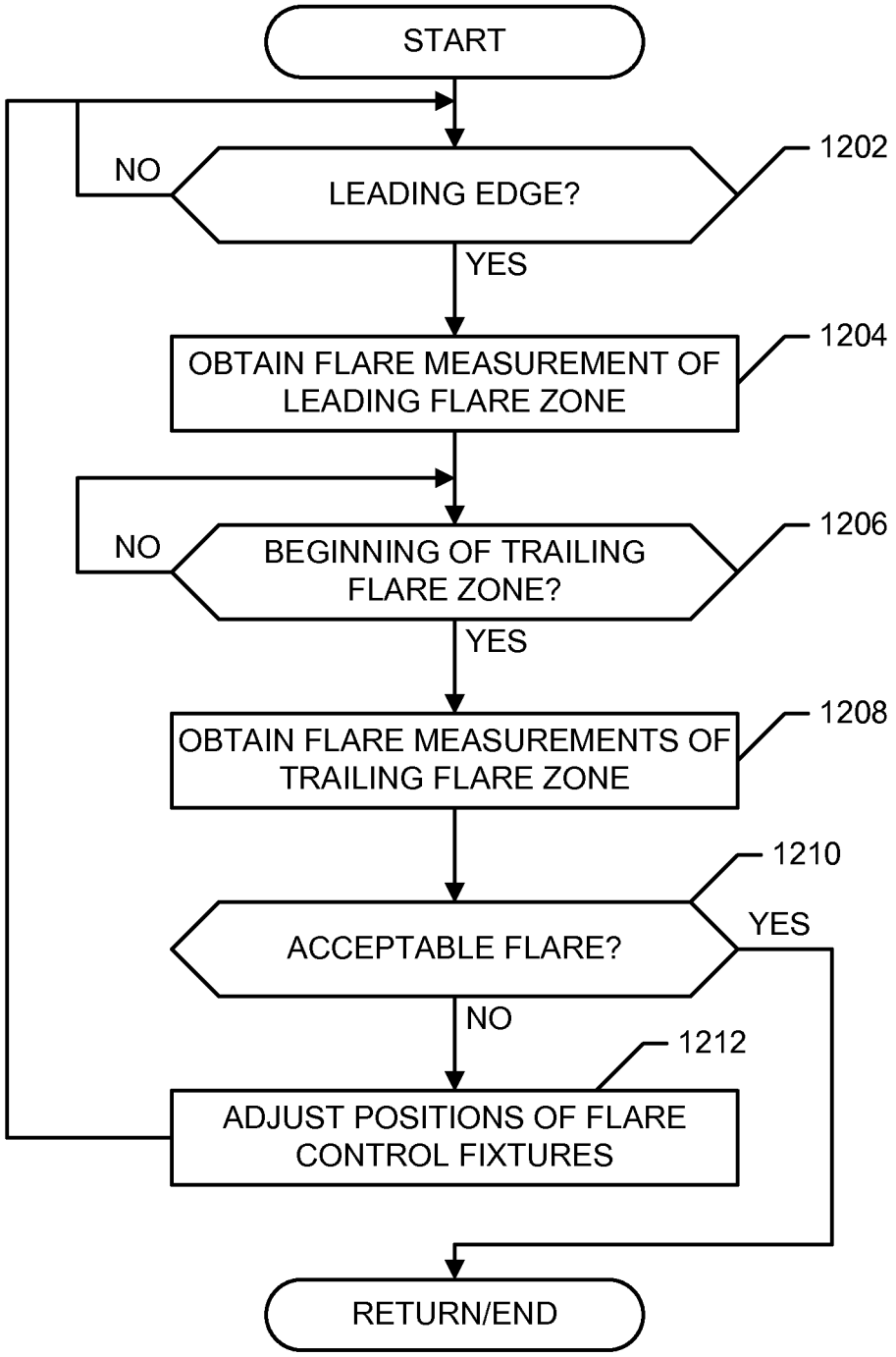
FIG. 12 is a flow diagram of an example feedback process that may be used to determine the positions of an operator side flange roller and a drive side flange roller.

FIG. 12 is a flow diagram of an example method of a feedback process for determining the positions (e.g., the angle 910 shown in FIG. 9) of an operator side flange roller (e.g., the operator side flange roller 1002 of FIG. 10) and a drive side flange roller (e.g., the drive side flange roller 1004 of FIG. 10). More specifically, the feedback process may be implemented in connection with the example flare control system 1000 (FIG. 10) by configuring the feedback sensors 1024*a* and 1024*b* (FIG. 10) to measure an amount of flare of a completely formed component (e.g., the example C-shaped component 800 of FIG. 8). The example processing system 1018 (FIG. 10) may then obtain the flare measurements from the feedback sensors 1024*a* and 1024*b* and determine optimal position values for the flange rollers 1002 and 1004 (FIG. 10) (i.e., values for the positions described in connection with blocks 1104, 1108, 1112, 1118 and 1112 of FIG. 11) based on a comparison of the flare measurements of the completed component and a flare tolerance specification value. The feedback process may be repeated based on one or more formed components until optimal position values are attained. Alternatively, the feedback process may be continuously performed during the operation of, for example, the example roll-former system 100 (FIG. 1). In this manner, the feedback system may be used to monitor the quality of the formed components. Additionally, if the characteristics of the material change during operation of the example roll-former system 100, the feedback system may be used to update the position values for the flange rollers 1002 and 1004 to adaptively vary the position value to achieve a desired flare value (i.e., to meet a flare tolerance or specification).

The feedback process may be performed in connection with the example method of FIG. 11. Additionally, one of ordinary skill in the art will readily appreciate that the feedback process may be implemented using the operator side feedback sensor 1024*a* and/or the drive side feedback sensor 1024*b*. However, for purposes of clarity, the feedback process is described, by way of example, as being based on the operator side feedback sensor 1024*a*.

Initially, the feedback process determines if the leading edge 808 (FIG. 8) of the example C-shaped component 800 (FIG. 8) has reached the operator side feedback sensor 1024*a* (block 1202). The operator side feedback sensor 1024*a* may be used to detect the leading edge 808 and may alert, for example, the example processor system 1018 when the leading edge 808 is detected. If the leading edge 808 has not reached the operator side feedback sensor 1024*a*, the feedback process may remain at block 1202 until the leading edge 808 reaches the operator side feedback sensor 1024*a*. On the other hand, if the leading edge 808 has reached the operator side feedback sensor 1024*a*, the operator side feedback sensor 1024*a* obtains a flare measurement associated with the leading flare zone 812 (FIG. 8) (block 1204). For example, the example processor system 1018 may configure the operator side feedback sensor 1024*a* to acquire a flare measurement value (block 1204) associated with the leading flare angle 816 (FIG. 8) after the leading edge 808 is detected (block 1202). The example processor system 1018 may then obtain and store the flare measurement value and/or the value of the leading flare angle 816.

The feedback process then determines if the beginning of the trailing flare zone 814 has reached the operator side feedback sensor 1024*a* (block 1206). If the beginning of the trailing flare zone 814 has not reached the operator side feedback sensor 1024*a*, the feedback process may remain at block 1206 until the beginning of the trailing flare zone 814 reaches the operator side feedback sensor 1024*a*. However, if the beginning of the trailing flare zone 814 has reached the operator side feedback sensor 1024*a*, the example processor system 1018 may configure the operator side feedback sensor 1024*a* to obtain a flare measurement value associated with the trailing flare angle 818 (FIG. 8) of the trailing flare zone 814 (block 1208).

The flare measurement value of the leading flare zone 812 and the flare measurement value of the trailing flare zone 814 may then be compared to a flare tolerance value to determine if the flare in the example C-shaped component 800 is acceptable (block 1210). The flare tolerance value for the leading flare zone 812 may be different from the flare tolerance value for the trailing flare zone 814. Alternatively, the flare tolerance values may be equal to one another. A flare measurement value is acceptable if it is within the flare tolerance value. More specifically, if the flange structure 804*a* (FIG. 10) is specified to form a 90 degree angle with the web 806 (FIG. 10) and is specified to be within +/−5 degrees, the flare tolerance value is +/−5 degrees. In this case, when the flare measurement values of the leading flare zone 812 and the trailing flare zone 814 are received, they are compared with the +/−5 degrees flare tolerance value. The flare measurement values are acceptable if they are within the flare tolerance value of +/−5 degrees (i.e., 85 degrees<acceptable flare measurement value<95 degrees).

If it is decided at block 1210 that one or both of the flare measurement values are not acceptable, the position values of the operator side flange roller 1002 are adjusted (block 1212). For example, if the flare measurement value of the leading flare zone 812 is not acceptable, the first position of the operator side flange roller 1002 described in connection with block 1104 of FIG. 11 is adjusted. Alternatively or additionally, if the flare measurement value of the trailing flare zone 814 is not acceptable, the fourth position of the operator side flange roller 1002 described in connection with block 1118 of FIG. 11 is adjusted. After one or more of the position values are adjusted, control is passed back to block 1202.

If it is decided at block 1210 that both of the flare measurement values are acceptable, the feedback process may be ended. Alternatively, although not shown, if the feedback process is used in a continuous mode (e.g., a quality control mode), control may be passed back to block 1202 from block 1210 when the flare measurement values are acceptable.

Figure 13:
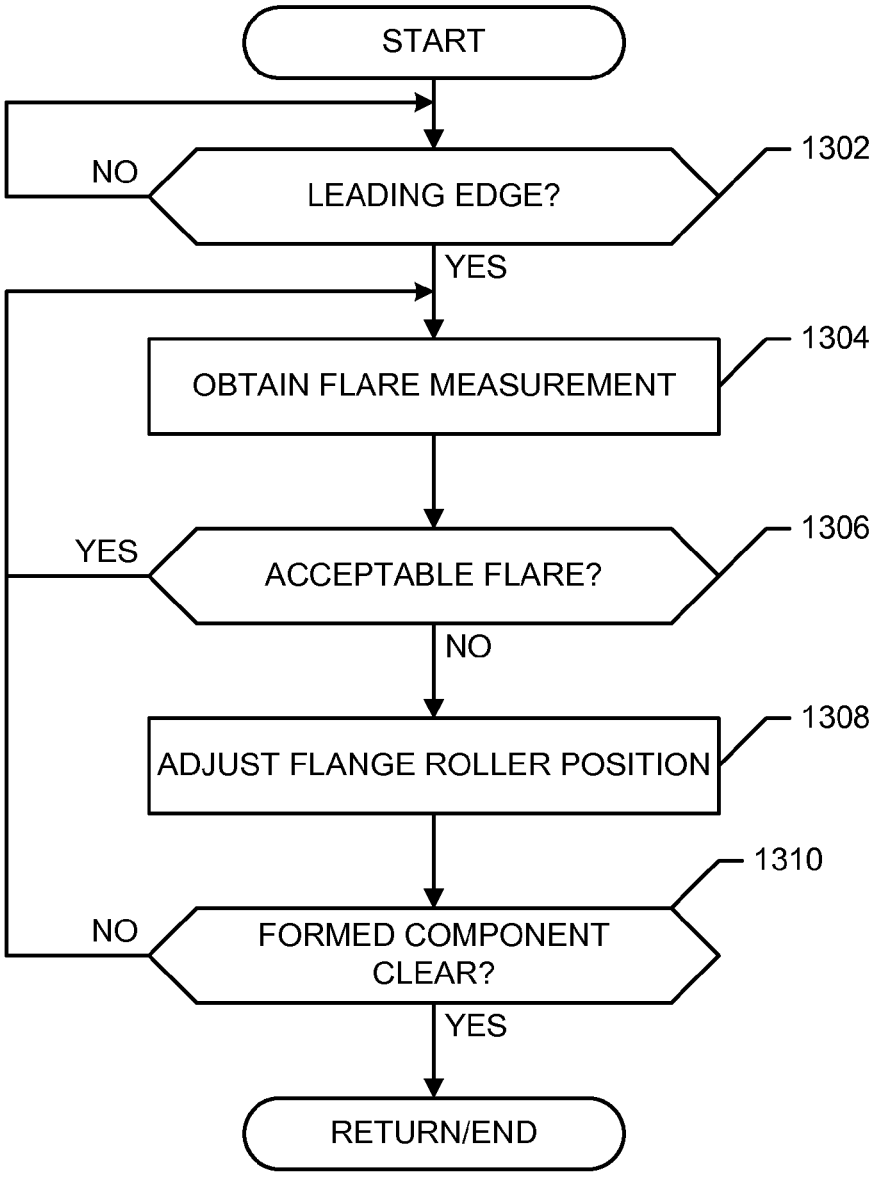
FIG. 13 is a flow diagram depicting another example manner in which the example flare control system of FIG. 10 may be configured to control the flare of a formed component.

FIG. 13 is a flow diagram depicting another example manner in which the example flare control system 1000 of FIG. 10 may be configured to control the flare of a formed component (e.g., the example C-shaped component 800 shown in FIG. 8). In addition to using the example flare control system 1000 of FIG. 10 in connection with predetermined positions (e.g., the angle 910 shown in FIG. 9) of the operator side flange roller 1002 (FIG. 10) and the drive side flange roller 1004 (FIG. 10) as described above in connection with the example method of FIG. 11, the example flare control system 1000 may also be used in a flange roller position adjustment configuration. In particular, the component sensors 1022*a-b* may be configured to measure an amount of flare associated with, for example, the flange structures 804*a-b* (FIG. 8), as the example C-shaped component 800 travels through the example flare control system 1000. The example processor system 1018 (FIG. 10) may then cause the position adjustment systems 1008 and 1014 to adjust the positions of the flange rollers 1004 and 1008, respectively, in response to the flare measurements. As described below, this process may be performed continuously along the length of the example C-shaped component 800. One of ordinary skill in the art will readily appreciate that the example method of FIG. 13 may be implemented using the operator side component sensor 1022*a* and/or the drive side component sensor 1022*b*. However, for purposes of clarity, the example method of FIG. 13 is described, by way of example, as being based on the operator side component sensor 1022*a*.

Initially, the example method determines if the leading edge 808 (FIG. 8) of the example C-shaped component 800 (FIG. 8) has reached the operator side component sensor 1022*a* (block 1302). The operator side component sensor 1022*a* may be used to detect the leading edge 808 and may alert, for example, the example processor system 1018 when the leading edge 808 is detected. If the leading edge is not detected (i.e., has not reached the operator side component sensor 1022*a*), the example method may remain at block 1302 until the leading edge is detected. If the leading edge is detected at block 1302, the operator side component sensor 1022*a* may obtain a flare measurement of, for example, the flange structure 804*a* (FIG. 8) (block 1304). The operator side component sensor 1022*a* may be configured to communicate an interrupt or alert to the example processor system 1018 indicating that a flare measurement has been obtained. Alternatively, the example processor system 1018 may poll the operator side component sensor 1022*a* in a continuous manner to read a continuously updated flare measurement value. The example processor system 1018 may alternatively be configured to assert measurement commands to the operator side component sensor 1022*a* so that the operator side component sensor 1022*a* obtains a flare measurement at times determined by the example processor system 1018.

The flare measurement value may then be compared with a flare tolerance specification value to determine if the flare measurement value is acceptable (block 1306) as described above in connection with block 1210 of FIG. 12. If it is determined at block 1306 that the flare measurement value is acceptable, control is passed back to block 1304. However, if it is determined that the flare measurement value is not acceptable, the position (e.g., the angle 910 shown in FIG. 9) of the operator side flange roller 1002 is adjusted (block 1306). For example, the example processor system 1018 may determine a difference value between the flare measurement value and a flare tolerance specification value and configure the position adjustment system 1008 to change or adjust the position of the operator side flange roller 1002 based on the difference value. The position adjustment system 1008 may then push, bend, and/or otherwise form, for example, the flange structure 804*a* to be within the flare tolerance specification value.

It is then determined if the example C-shaped component 800 is clear or has traveled beyond proximity of the operator side component sensor 1022*a* (block 1310). If the example C-shaped component 800 is not clear, control is passed back to block 1304. However, if the example C-shaped component 800 is clear, the example method is stopped. Alternatively, although not shown, if the example C-shaped component 800 is clear, control may be passed back to block 1302 to perform the example method for another formed component.

The example methods described above in connection with FIGS. 11-13 may be implemented in hardware, software, and/or any combination thereof. In particular, the example methods may be implemented in hardware defined by the example flare control system 1000 and/or the example system 1400 of FIG. 14. Alternatively, the example method may be implemented by software and executed on a processor system such as, for example, the example processor system 1018 of FIG. 10.

Figure 14:
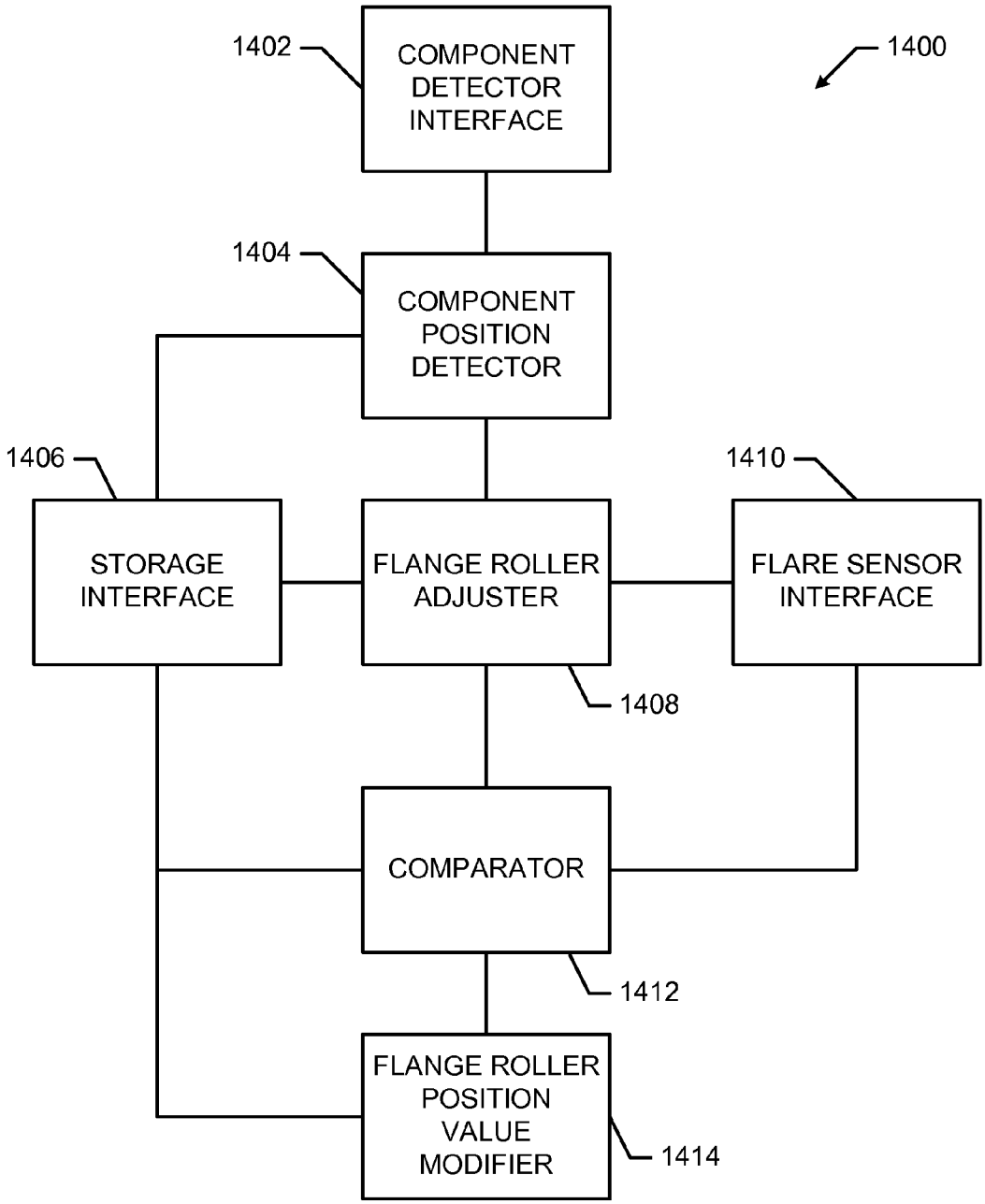
FIG. 14 is a block diagram of an example system that may be used to implement the example methods described herein.

FIG. 14 is a block diagram of an example system 1400 that may be used to implement the example methods and apparatus described herein. In particular, the example system 1400 may be used in connection with the example flare control system 1000 of FIG. 10 to adjust the positions of the flange rollers 1002 and 1004 (FIG. 10) in a manner substantially similar or identical to the example method of FIG. 11. The example system 1400 may also be used to implement a feedback process substantially similar or identical to the feedback process described in connection with FIG. 12.

As shown in FIG. 14, the example system 1400 includes a component detector 1402, a component position detector 1404, a storage interface 1406, a flange roller adjuster 1408, a flare sensor interface 1410, a comparator 1412, and a flange roller position value modifier 1414, all of which are communicatively coupled as shown.

The component detector interface 1402 and the component position detector 1404 may be configured to work cooperatively to detect a component (e.g., the example C-shaped component 800 of FIG. 8) and the position of the component during, for example, operation of the example flare control system 1000 (FIG. 10). In particular, the component detector interface 1402 may be communicatively coupled to a sensor and/or detector such as, for example, the component sensors 1022*a-b* of FIG. 10. The component detector interface 1402 may periodically read (i.e., poll) a detection flag or detection value from the component sensors 1022*a-b* to determine if, for example, the leading edge 808 of the example C-shaped component 800 is in proximity of the component sensors 1022*a-b*. Alternatively or additionally, the component detector interface 1402 may be interrupt driven and may configure the component sensors 1022*a-b* to send an interrupt or alert when the example C-shaped component 800 is detected.

The component position detector 1404 may be configured to determine the position of the example C-shaped component 800 (FIG. 8). For example, as the example C-shaped component 800 travels through the example flare control system 1000 (FIG. 10), the component position detector 1404 may determine when the end of the leading flare zone 812 (FIG. 8) reaches the flange rollers 1002 and 1004 (FIG. 10). Furthermore, the component position detector 1404 may be used in connection with the blocks 1106, 1110, 1116, and 1120 of FIG. 11 to determine when various portions of the example C-shaped component 800 reach the flange rollers 1002 and 1004.

The component position detector 1404 may be configured to obtain interrupts or alerts from the component detector interface 1402 indicating when the leading edge 808 or the trailing edge 810 of the example C-shaped component 800 is detected. In one example, the component position detector 1404 may retrieve manufacturing values from the storage interface 1406 and determine the position of the example C-shaped component 800 based on the interrupts or alerts from the component detector interface 1402 and the manufacturing values. The manufacturing values may include a velocity of the example C-shaped component 800, a length of the example C-shaped component 800, the detector to operator side flange roller distance 1028 (FIG. 10), the detector to drive side flange roller distance 1030 (FIG. 10), and timer values, all of which may be used to determine the time duration required for the leading edge 808 to reach the side flange rollers 1002 and 1004 as described above in connection with FIG. 10.

The storage interface 1406 may be configured to store data values in a memory such as, for example, the system memory 1524 and the mass storage memory 1525 of FIG. 15. Additionally, the storage interface 1406 may be configured to retrieve data values from the memory. For example, as described above, the storage interface 1406 may obtain manufacturing values from the memory and communicate them to the component position detector 1404. The storage interface 1406 may also be configured to obtain position values for the flange rollers 1002 and 1004 (FIG. 10) and communicate the position values to the flange roller adjuster 1408. Additionally, the storage interface 1406 may obtain flare tolerance values from the memory and communicate the flare tolerance values to the comparator 1412.

The flange roller adjuster 1408 may be configured to obtain position values from the storage interface 1406 and adjust the position of, for example, the flange rollers 1002 and 1004

(FIG. 10) based on the position values. The flange roller adjuster 1408 may be communicatively coupled to the position adjustment system 1008 (FIG. 10) and the linear encoder 1006 (FIG. 10). The flange roller adjuster 1408 may then drive the position adjustment system 1008 to change the position of the operator side flange roller 1002 and obtain displacement measurement values from the linear encoder 1006 that indicate the distance or angle by which the operator side flange roller 1002 has been adjusted or displaced. The flange roller adjuster 1408 may then communicate the displacement measurement values and the position values to the comparator 1412. The flange roller adjuster 1408 may then continue to drive or stop the position adjustment system 1008 based on a comparison of the displacement measurement values and the position values.

The flare sensor interface 1410 may be communicatively coupled to a flare measurement sensor or device (e.g., the feedback sensors 1024*a* and 1024*b* of FIG. 10) and configured to obtain flare measurement values of, for example, the example C-shaped component 800 (FIG. 8). The flare sensor interface 1410 may periodically read (i.e., poll) flare measurement values from the feedback sensors 1024*a* and 1024*b*. Alternatively or additionally, the flare sensor interface 1410 may be interrupt driven and may configure the feedback sensors 1024*a* and 1024*b* to send an interrupt or alert when a flare measurement value has been obtained. The flare sensor interface 1410 may then read the flare measurement value from one or both of the feedback sensors 1024*a* and 1024*b* in response to the interrupt or alert. Additionally, the flare sensor interface 1410 may also configure the feedback sensors 1024*a* and 1024*b* to detect the presence or absence of the example C-shaped component 800 as described in connection with block 1124 of FIG. 11.

The comparator 1412 may be configured to perform comparisons based on values obtained from the storage interface 1406, the flange roller adjuster 1408, and the flare sensor interface 1410. For example, the comparator 1412 may obtain flare measurement values from the flare sensor interface 1410 and flare tolerance values from the storage interface 1406. The comparator 1412 may then communicate the results of the comparison of the flare measurement values and the flare tolerance values to the flange roller position value modifier 1414.

The flange roller position value modifier 1414 may be configured to modify flange roller position values (e.g., values for the positions described in connection with blocks 1104, 1108, 1112, 1118 and 1122 of FIG. 11) based on the comparison results obtained from the comparator 1412. For example, if the comparison results obtained from the comparator 1412 indicate that a flare measurement value is greater than or less than the flare tolerance value, the flange roller position may be modified accordingly to change an angle (e.g., the angle 910 of FIG. 9) of, for example, one or both of the flange rollers 1002 and 1004.

FIG. 15 is a block diagram of an example processor system 1510 that may be used to implement the apparatus and methods described herein. As shown in FIG. 15, the processor system 1510 includes a processor 1512 that is coupled to an interconnection bus or network 1514. The processor 1512 includes a register set or register space 1516, which is depicted in FIG. 15 as being entirely on-chip, but which could alternatively be located entirely or partially off-chip and directly coupled to the processor 1512 via dedicated electrical connections and/or via the interconnection network or bus 1514. The processor 1512 may be any suitable processor, processing unit or microprocessor. Although not shown in FIG. 15, the system 1510 may be a multi-processor system and, thus, may include one or more additional processors that are identical or similar to the processor 1512 and that are communicatively coupled to the interconnection bus or network 1514.

The processor 1512 of FIG. 15 is coupled to a chipset 1518, which includes a memory controller 1520 and an input/output (I/O) controller 1522. As is well-known, a chipset typically provides I/O and memory management functions as well as a plurality of general purpose and/or special purpose registers, timers, etc. that are accessible or used by one or more processors coupled to the chipset. The memory controller 1520 performs functions that enable the processor 1512 (or processors if there are multiple processors) to access a system memory 1524 and a mass storage memory 1525.

The system memory 1524 may include any desired type of volatile and/or non-volatile memory such as, for example, static random access memory (SRAM), dynamic random access memory (DRAM), flash memory, read-only memory (ROM), etc. The mass storage memory 1525 may include any desired type of mass storage device including hard disk drives, optical drives, tape storage devices, etc.

The I/O controller 1522 performs functions that enable the processor 1512 to communicate with peripheral input/output (I/O) devices 1526 and 1528 via an I/O bus 1530. The I/O devices 1526 and 1528 may be any desired type of I/O device such as, for example, a keyboard, a video display or monitor, a mouse, etc. While the memory controller 1520 and the I/O controller 1522 are depicted in FIG. 15 as separate functional blocks within the chipset 1518, the functions performed by these blocks may be integrated within a single semiconductor circuit or may be implemented using two or more separate integrated circuits.

The methods described herein may be implemented using instructions stored on a computer readable medium that are executed by the processor 1512. The computer readable medium may include any desired combination of solid state, magnetic and/or optical media implemented using any desired combination of mass storage devices (e.g., disk drive), removable storage devices (e.g., floppy disks, memory cards or sticks, etc.) and/or integrated memory devices (e.g., random access memory, flash memory, etc.).

Figure 16:
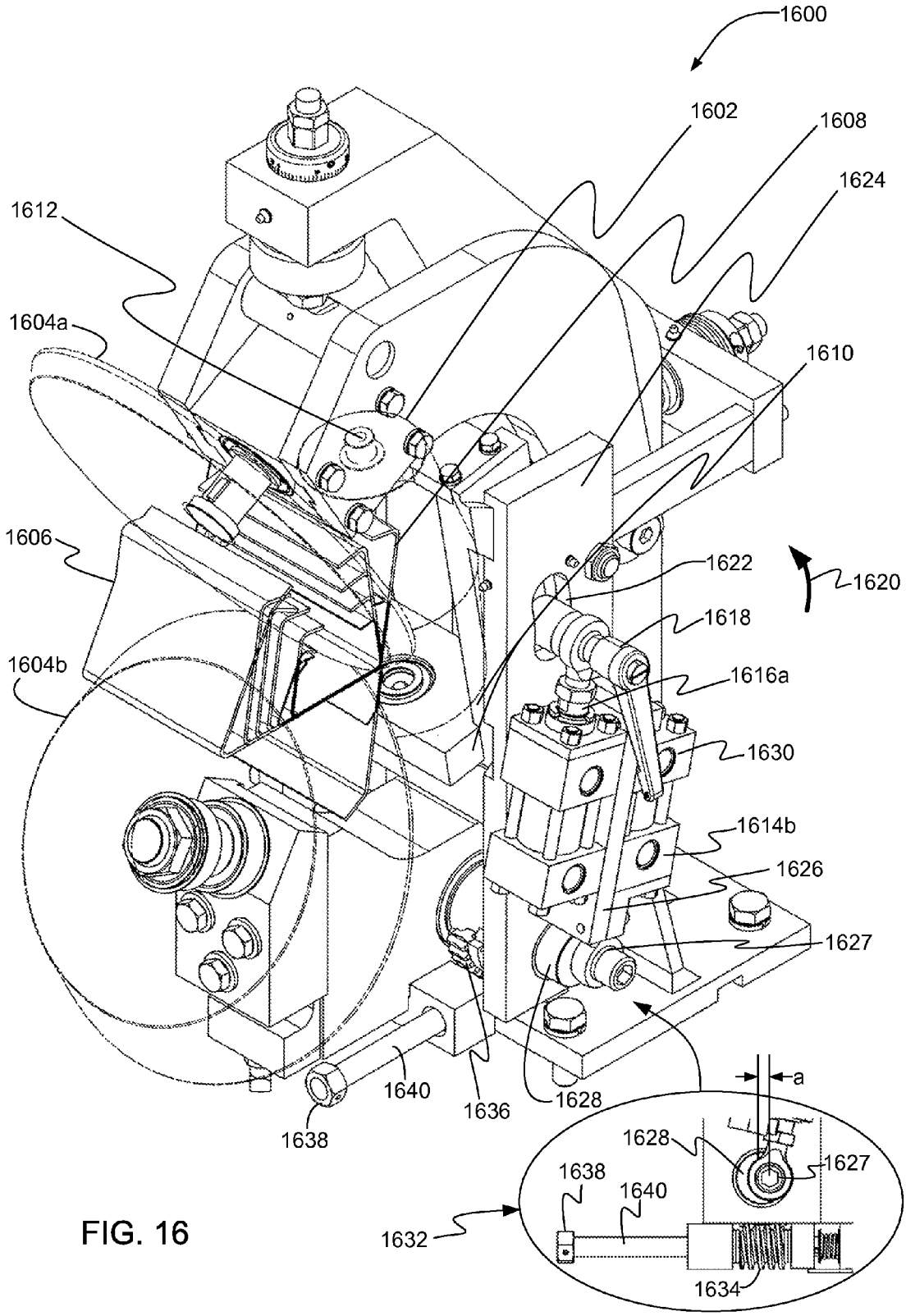
FIG. 16 is an isometric view of another example forming unit.

FIG. 16 is an isometric view of another example forming unit 1600. In some example implementations, the example forming unit 1600 may be used to implement a final forming pass of the example roll-former system 100 (FIG. 1) such as, for example, the forming pass 108*g* to control flare in roll-formed components (e.g., the C-shaped component 200 of FIG. 2A and/or the Z-shaped component 250 of FIG. 2B). As discussed below, the example forming unit 1600 is structured to control an angle of a flange roller 1602 in accordance with pre-defined or pre-set roller angle values that define the tilt or pivot of the flange roller 1602. Such tilt or pivot positions can be substantially similar or identical to the tilt or pivot positioning of the roller 904 of FIG. 9.

As shown in FIG. 16, the example forming unit 1600 includes an upper side roller 1604*a* and a lower side roller 1604*b*, which receive a roll-formed component 1606, while the flange roller 1602 is pivoted or tilted relative to a flange 1608 of the component 1606 to condition flare in the flange 1608. In the illustrated example, profiles of several formed components are shown to illustrate some example profiles that can be used in connection with the example forming unit 1600. However, during operation, one formed component is conditioned by the forming unit 1600.

In the illustrated example, the flange roller 1602 is rotatably coupled to a cage 1610 via a shaft 1612 passing through the axial center of the flange roller 1602. In this manner, as the component 1606 moves through the example forming unit 1600 and the flange roller 1602 engages the flange 1608 of the component 1606, the flange roller 1602 can spin freely about the shaft 1612 while riding on the surface of the flange 1608.

Figure 17:
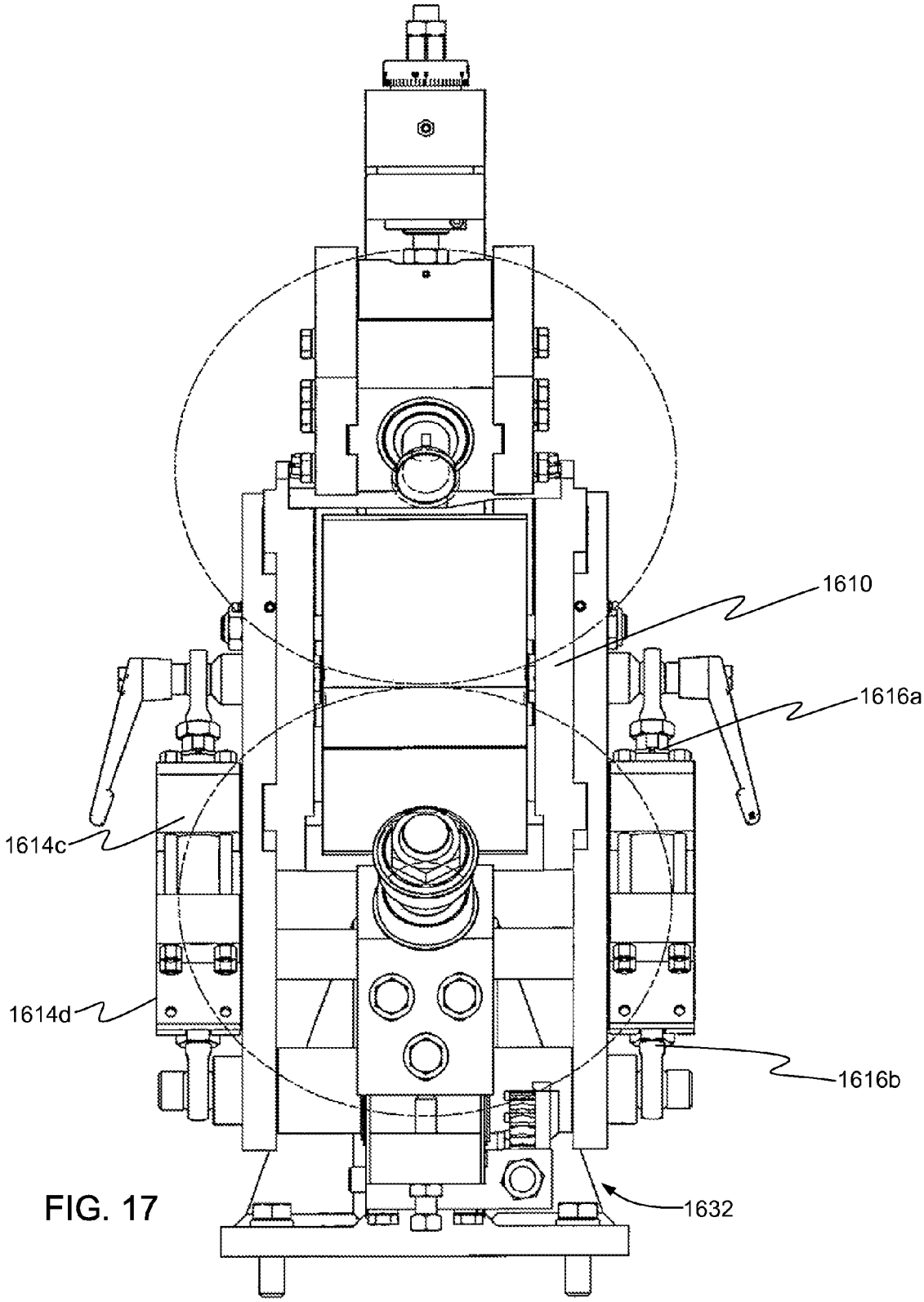
FIG. 17 is a front view of the example forming unit of FIG. 16.

To actuate the angle of the flange roller 1602, the example forming unit 1600 is provided with actuators 1614*a* and 1614*b*. In the illustrated example, the actuators 1614*a-b* are implemented using pneumatic cylinders (i.e., air cylinders or pneumatic pistons). The actuator 1614*a* includes a retractably extendable piston 1616*a*, and the actuator 1614*b* includes a piston 1616*b* (FIG. 17). The piston 1616*a* is coupled to a shaft 1618 extending from the cage 1610 in a direction substantially perpendicular to the axial center of the flange roller 1602. In this manner, when the piston 1616*a* extends, the shaft 1618 urges the cage 1610 in an arched path generally indicated by arrow 1620. This movement causes the flange roller 1602 to be pivoted or tilted to change its angular position relative to the component 1606. To facilitate the arched movement of the cage 1610, an arched slot 1622 is formed in a vertical frame side support 1624 of the example forming unit 1600. The shaft 1618 passes through the arched slot 1622, which guides the shaft 1618 along the arched path 1620 when actuated by the piston 1616*a* and/or the piston 1616*b* as discussed below.

The example forming unit 1600 is structured to further actuate the angular position of the flange roller 1602 through use of the actuator 1614*b*. In particular, the actuators 1614*a-b* are fixedly mounted to one another via an intervening plate 1626, and the piston 1616*b* of the actuator 1614*b* is coupled to a stub shaft 1627 protruding from an adjustment shaft 1628. In the illustrated example, the actuators 1614*a-b* are mounted to one another in a manner such that when the piston 1616*a* of the actuator 1614*a* extends in a first direction and the piston 1616*b* of the actuator 1614*b* extends in a second direction substantially opposite the first direction. When the piston 1616*b* is extended, the piston 1616*b* pushes against the adjustment shaft 1628 urging a body 1630 of the actuator 1614*b* away from the adjustment shaft 1628. The body 1630, in turn, causes the actuator 1614*a* to also move away from the adjustment shaft 1628 as a result of the actuators 1614*a-b* being fixedly coupled to one another. This movement further urges the cage 1610 along the arched path 1620 causing the flange roller 1602 to be further pivoted or tilted and, thus, further changing its angular position relative to the component 1606.

To pre-set or pre-define the angles of the flange roller 1602 created by actuation of the actuators 1614*a-b*, the example forming unit 1600 is provided with a manual worm drive adjuster 1632 including a worm element 1634 meshed with a worm gear 1636. The worm gear 1636 is fixedly coupled to or integrally formed with an outer arcuate surface of the shaft 1628 such that when the worm element 1634 is rotated or turned, the worm gear 1636 turns the shaft 1628 about its central axis. As shown in FIG. 16, the stub shaft 1627 is off-center relative to the central axis of the shaft 1628 by a distance (a). Thus, when the shaft 1628 rotates about its central axis, the stub shaft 1627 travels along an offset circular path, thus, adjusting the positions of the actuators 1614*a-b* relative to the shaft 1628. In the illustrated example, the manual worm drive adjuster 1632 is provided with a manual adjustment member 1638 fixedly coupled to the worm element 1634 via a shaft 1640. The manual adjustment member 1638 enables an operator to turn the manual adjustment member 1638 to pre-set a resting angle of the flange roller 1602 depicted at a first phase ($t_0$) of FIG. 19. Due to the actuators 1614*a-b* being operatively coupled to one another and the shafts 1618 and 1628 as discussed above, pre-setting the resting angle of the flange roller 1602, in turn defines pre-set angles of the flange roller 1602 when actuated as discussed below in connection with the phases ($t_1$) and ($t_2$) of FIG. 19. By adjusting the positions of the actuators 1614*a-b* in this manner, an operator can pre-set or pre-define all of the angles of the flange roller 1602 (shown at phases ($t_1$), ($t_2$), and ($t_3$) of FIG. 19) simultaneously to overform flared-out portions (e.g., flanges) of roll-formed components by any desired amount to substantially reduce or eliminate the flare in those portions.

During operation of the example forming unit 1600, the flange roller 1602 is actuated by the actuators 1614*a-b* to the pre-set angles selected or defined using the manual worm drive adjuster 1632. An example time sequence diagram 1900 showing the movements of the flange roller 1602 created by the actuators 1614*a-b* is shown in FIG. 19 and discussed below.

FIG. 17 is a front view of the example forming unit 1600 of FIG. 16. As shown, the example forming unit 1600 is provided with a second set of actuators 1614*c* and 1614*d* on the other side of the example forming unit 1600 opposite the actuators 1614*a-b* described above. The actuators 1614*c-d* are operatively coupled to one another, the cage 1610, and the manual worm drive adjuster 1632 in similar fashion as discussed above in connection with the actuators 1614*a-b*. In this manner, all of the actuators 1614*a-d* can work in a cooperative manner to actuate the cage 1610 and, thus, drive the flange roller 1602 to its pre-set angles as discussed below in connection with FIG. 19. The actuators 1614*c-d* are shown more clearly in the rear isometric view of the example forming unit 1600 of FIG. 18. In particular, a piston 1616*c* of the actuator 1614*c* is shown coupled to a shaft 1802, which is similar to the shaft 1618 of FIG. 16. The shaft 1802 is coupled to the cage 1610 in similar fashion as the shaft 1618 as discussed above. In addition, a piston 1616*d* of the actuator 1614*d* is coupled to the shaft 1628. Also, the actuators 1614*c-d* are shown fixedly coupled to one another via a plate 1804.

Figure 18:
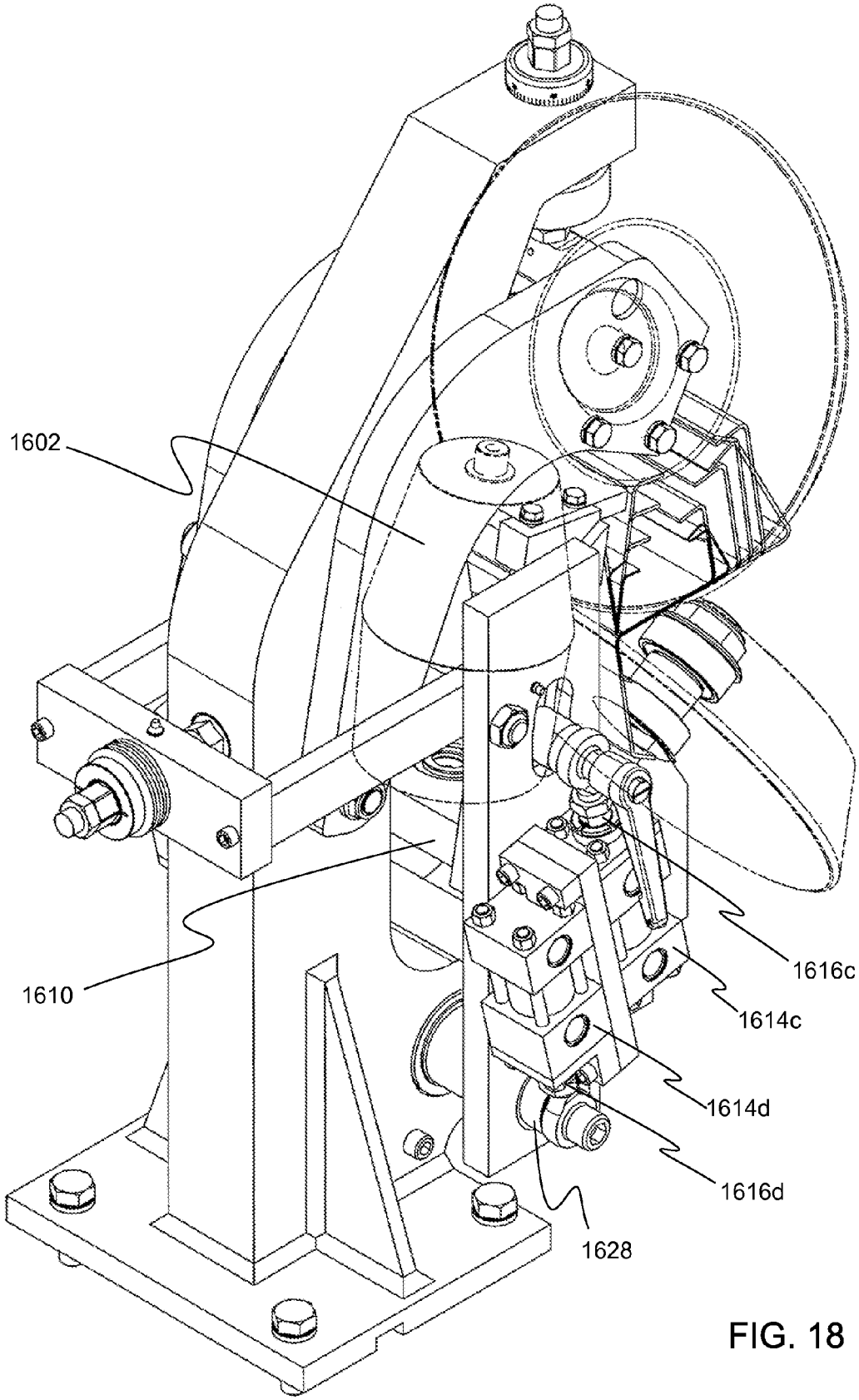
FIG. 18 is a rear isometric view of the example forming unit of FIGS. 16 and 17.
Figure 19:
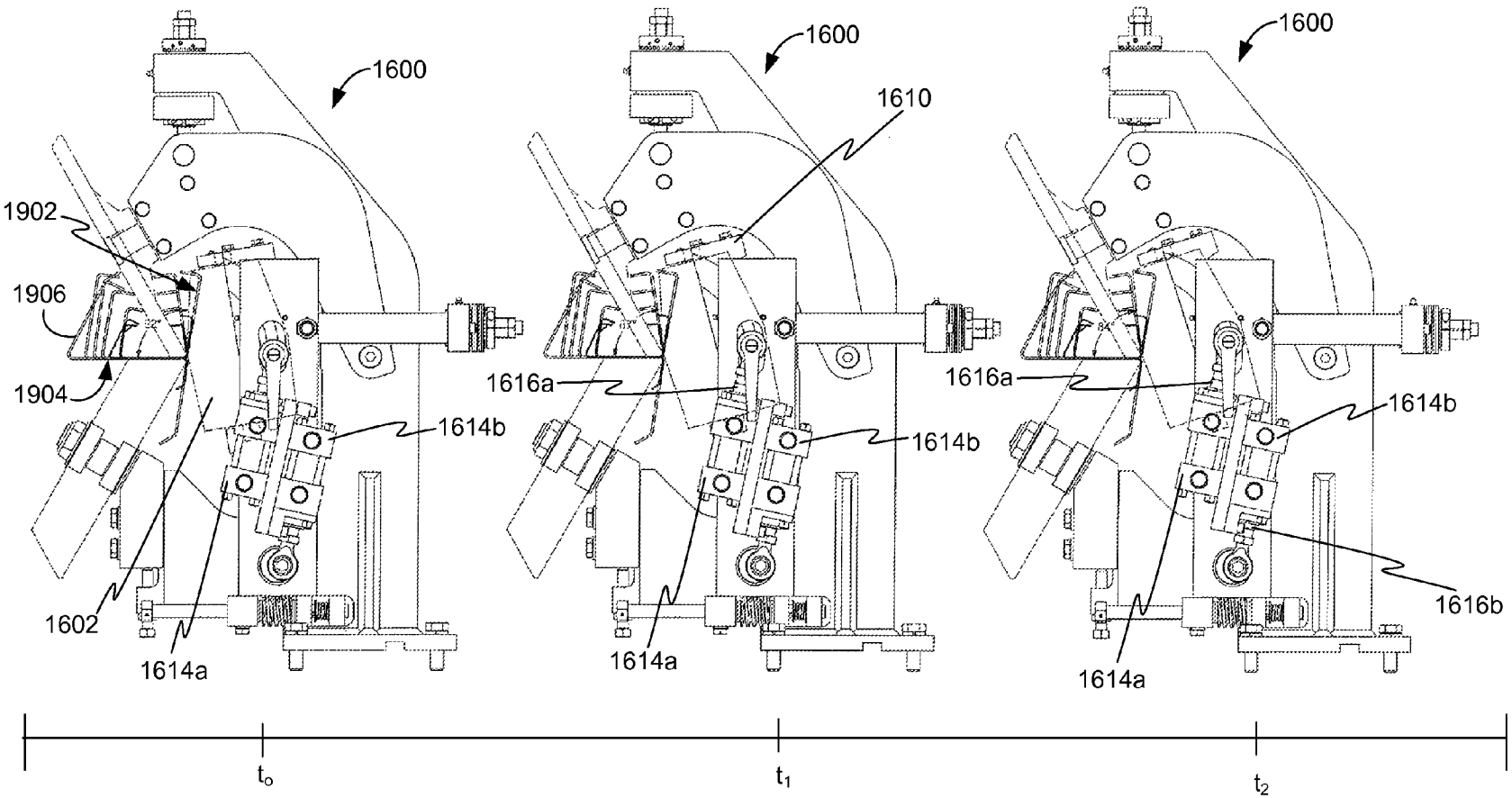
FIG. 19 is an example time sequence view depicting the operation of the example forming unit of FIG. 16.

FIG. 19 is an example time sequence view 1900 depicting the operation of the example forming unit 1600 of FIGS. 16-18. The time sequence view 1900 includes three phases ($t_0$), ($t_1$), and ($t_2$) of the example forming unit 1600. In the first phase ($t_0$), the actuators 1614*a-d* are in closed positions in which all of the pistons 1616*a-d* are retracted. In the illustrated example, when the actuators 1614*a-d* are closed, the flange roller 1602 is at a first pre-set angle. That is, a formed component-engagement surface 1902 of the flange roller 1602 is at a first pre-set angle position (e.g., a 92-degree angle) relative to a web portion 1904 of the formed component 1606.

During the second phase ($t_1$), the actuators 1614*a* and 1614*c* are activated and the pistons 1616*a* and 1616*c* are extended to urge the cage 1610 along the upward arched path 1620 discussed above in connection with FIG. 16. At the second phase ($t_1$), the pistons 1616*b* and 1616*d* are not actuated and, thus, the pistons 1614*b* and 1614*d* remain retracted. In this manner, because only the pistons 1616*a* and 1616*c* are extended, the flange roller 1602 is driven to a second pre-set angle. In the illustrated example, the second pre-set angle between the formed component-engagement surface 1902 of the flange roller 1602 and the web portion 1904 of the component 1606 is 87 degrees.

During the third phase ($t_2$), all of the actuators 1614*a-d* are activated and, thus, all of the pistons 1616*a-d* are extended to urge the cage 1610 further along the upward arched path 1620. In this manner, the flange roller 1602 is driven to a third pre-set angle. In the illustrated example, the third pre-set angle between the formed component-engagement surface

1902 of the flange roller 1602 and the web portion 1904 of the component 1606 is 84 degrees.

In the illustrated example, the actuators 1614*a-d* can be controlled by a controller such as the processor system 1018 of FIG. 10. For example, when the processor system 1018 detects different zones of the formed component 800 (FIGS. 8A, 8B, and 10), the processor system 1018 can actuate the actuators 1614*a* and 1614*c* simultaneously and the actuators 1614*b* and 1614*d* simultaneously to drive the flange roller 1604 to the different angular positions as discussed in connection with FIG. 19. The angles of the flange roller 1602 shown in the second and third phases ($t_1$) and ($t_2$) of FIG. 19 can be used to provide different amounts of conditioning to different zones of a component. For instance, if the sensors 1022*a-b* detect that the leading zone 808 of the component 800 has less flare out than the trailing zone 810, the processor system 1018 may actuate only the actuators 1614*a-c* for the leading zone 808 but actuate all of the actuators 1614*a-d* for the trailing zone 810. In addition, the angles of the second and third phases ($t_0$) and ($t_1$) can be actuated sequentially in a time-controlled manner to create a gradual overforming motion with the flange roller 1602 to a particular zone of the component 800. Such a gradual motion can be used to avoid structural damage to the component 800 that may otherwise result from bending a flange of the component 800 too quickly.

The example time sequence view 1900 of FIG. 19 shows that the actuators 1614*a* and 1614*c* are actuated first, followed by actuation of the actuator 1614*b* and 1614*d*. However, in other example implementations, the actuators 1614*b* and 1614*d* may be actuated first to tilt the flange roller 1602 to the second pre-set angle of the second phase ($t_1$), and subsequently, the actuators 1614*a* and 1614*c* may be actuated to further tilt the flange roller 1602 to the third pre-set angle of the third phase ($t_2$).

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A method for controlling flare in formed components, comprising:

predefining a plurality of position values to adjust a tilt angle of a flange roller by adjusting a manual adjuster to pre-set the tilt angle of the flange roller, wherein the manual adjuster is a worm driver adjuster comprising a worm element meshed with a worm gear; and adjusting the tilt angle of the flange roller based on one of the pre-defined position values to change an amount of flare in a zone of a component, the one of the pre-defined position values associated with the zone of the component.

2. A method for controlling flare in formed components, comprising:

predefining a plurality of position values to adjust a tilt angle of a flange roller; and adjusting the tilt angle of the flange roller based on one of the pre-defined position values to change an amount of flare in a zone of a component, the one of the pre-defined position values associated with the zone of the component, wherein adjusting the tilt angle of the flange roller based on the one of the pre-defined position values comprises adjusting the tilt angle of the flange roller using first and second pneumatic cylinders fixedly coupled to one another.

3. A method as defined in claim 2, wherein the first pneumatic cylinder extends a first piston in a first direction and the second pneumatic cylinder extends a second piston in a second direction opposite the first direction.

4. An apparatus, comprising:

a flange roller;

an adjuster to define pre-set angular positions of the flange roller;

a first actuator extending between the adjuster and the flange roller; and a first piston of the first actuator that, when extended from the first actuator, urges the flange roller to pivot to one of the pre-set angular positions to condition flare in a first zone of a roll-formed component.

5. An apparatus as defined in claim 4, further comprising:

a second actuator fixedly coupled to the first actuator and extending between the flange roller and the first actuator; and a second piston of the second actuator that, when extended from the second actuator, urges the flange roller to another one the pre-set angular positions.

6. An apparatus as defined in claim 5, further comprising a controller operatively coupled to the first actuator and the second actuator, the controller operable to extend the first piston of the first actuator without extending the second piston of the second actuator to condition the flare in the first zone of the roll-formed component, the controller further operable to extend the second piston of the second actuator while the first piston is simultaneously extended to condition flare in a second zone of the roll-formed component.

7. An apparatus as defined in claim 4, further comprising:

a cage to which the flange roller is rotatably coupled;

a frame side support having an arched slot formed therein;

a shaft extending from the cage through the arched slot in a direction perpendicular to an axial center of the flange roller, the first piston being coupled to the shaft, and the first piston, when extended from the first actuator, to move the shaft along an arched path formed by the arched slot to urge the flange roller to pivot to the one of the pre-set angular positions.

8. An apparatus as defined in claim 4, wherein the first piston is to be extended or retracted relative to the first actuator to pivot the flange roller a plurality of times based on different ones of the pre-set angular positions as the roll-formed component moves to provide different amounts of conditioning to other zones of the roll-formed component.

9. An apparatus as defined in claim 4, further comprising a controller to:

retrieve a position value from a database corresponding to the one of the pre-set angular positions; and cause the first piston to extend from the first actuator to the one of the pre-set angular positions based on the position value.

10. An apparatus, comprising:

a flange roller;

an adjuster to define pre-set angular positions of the flange roller;

an actuator extending between the adjuster and the flange roller, wherein the adjuster comprises a worm element meshed with a worm gear, the worm element operatively coupled to a manual adjustment member, the worm gear fixedly coupled to an arcuate surface of a first shaft operatively coupled to the actuator; and a first piston of the actuator that, when extended from the actuator, urges the flange roller to one of the pre-set angular positions to condition flare in a first zone of a roll-formed component.

11. An apparatus as defined in claim 10, wherein operating the manual adjustment member causes the worm gear to change the position of the actuator relative to the first shaft to simultaneously pre-define all of the pre-set angular positions.

12. An apparatus as defined in claim 10, further comprising:

a cage to which the flange roller is rotatably coupled;

a frame side support having an arched slot formed therein;

a second shaft extending from the cage through the arched slot in a direction perpendicular to an axial center of the flange roller, the first piston being coupled to the second shaft, and the first piston, when extended from the first actuator, to move the second shaft along an arched path formed by the arched slot to urge the flange roller to pivot to the one of the pre-set angular positions.

13. An apparatus as defined in claim 10, wherein the first piston is to be extended or retracted relative to the actuator to pivot the flange roller a plurality of times based on different ones of the pre-set angular positions as the roll-formed component moves to provide different amounts of conditioning to other zones of the roll-formed component.

14. A method for controlling flare in formed components, comprising:

predefining a plurality of position values to adjust a tilt angle of a flange roller; and adjusting the tilt angle of the flange roller based on one of the pre-defined position values to change an amount of flare in a zone of a component, the one of the pre-defined position values associated with the zone of the component, wherein adjusting the tilt angle of the flange roller based on the one of the pre-defined position values comprises adjusting the tilt angle of the flange roller using a controller operatively coupled to a first actuator and a second actuator, the controller to perform the adjusting by extending a first piston of the first actuator without extending a second piston of the second actuator to condition the flare in the zone of the component.

15. A method as defined in claim 14, further comprising adjusting the tilt angle of the flange roller based on another one of the pre-defined position values by using the controller to extend the second piston of the second actuator while the first piston is simultaneously extended to condition another zone of the component.

16. A method for controlling flare in formed components, comprising:

predefining a plurality of position values to adjust a tilt angle of a flange roller;

adjusting the tilt angle of the flange roller based on one of the pre-defined position values to change an amount of flare in a zone of a component, the one of the pre-defined position values associated with the zone of the component; and adjusting the tilt angle of the flange roller a plurality of times based on different ones of the pre-defined position values as the component moves to provide different amounts of conditioning to different zones of the component.

17. A method for controlling flare in formed components, comprising:

predefining a plurality of position values to adjust a tilt angle of a flange roller;

adjusting the tilt angle of the flange roller based on one of the pre-defined position values to change an amount of flare in a zone of a component, the one of the pre-defined position values associated with the zone of the component; and using first and second pneumatic cylinders to adjust the tilt angle of the flange roller a plurality of times based on different ones of the pre-defined position values as the component moves to provide different amounts of conditioning to different zones of the component.

* * * * *